US007486923B2

(12) United States Patent
Imai et al.

(10) Patent No.: US 7,486,923 B2
(45) Date of Patent: Feb. 3, 2009

(54) HEAT GENERATING ROLLER, FIXING EQUIPMENT, AND IMAGE FORMING APPARATUS

(75) Inventors: Masaru Imai, Osaka (JP); Noboru Katakabe, Kyoto (JP); Youichi Nakamura, Fukuoka (JP); Naoto Matsuo, Fukuoka (JP); Tomoyuki Noguchi, Fukuoka (JP)

(73) Assignee: Panasonic Corporation, Osaka (JP)

( * ) Notice: Subject to any disclaimer, the term of this patent is extended or adjusted under 35 U.S.C. 154(b) by 166 days.

(21) Appl. No.: 11/572,521

(22) PCT Filed: Jul. 26, 2005

(86) PCT No.: PCT/JP2005/013593

§ 371 (c)(1),
(2), (4) Date: Jan. 23, 2007

(87) PCT Pub. No.: WO2006/011454

PCT Pub. Date: Feb. 2, 2006

(65) Prior Publication Data

US 2008/0063445 A1 Mar. 13, 2008

(30) Foreign Application Priority Data

Jul. 26, 2004 (JP) ..... 2004-217663

(51) Int. Cl.
*G03G 15/20* (2006.01)

(52) U.S. Cl. ..... 399/333; 219/619; 399/330

(58) Field of Classification Search ..... 399/333, 399/330, 328, 329, 320; 219/216, 619; 347/156; 118/60; 492/46, 49, 53, 54
See application file for complete search history.

(56) References Cited

U.S. PATENT DOCUMENTS 5,568,240 A 10/1996 Otsuka ..... 399/335

(Continued)

FOREIGN PATENT DOCUMENTS

JP 7-114276 5/1995

(Continued)

OTHER PUBLICATIONS

Machine translation of JP 2004-151470 A dated Aug. 29, 2008.*

(Continued)

*Primary Examiner*—Sophia S Chen
(74) *Attorney, Agent, or Firm*—Greenblum & Bernstein, P.L.C.

(57) ABSTRACT

A heat generating roller, fixing equipment and an image forming apparatus in which warm-up time is shortened while preventing excessive temperature rise and good fixing performance is realized by preventing offset. The heat generating roller is formed principally by laying a high permeability conductive layer and a nonmagnetic conductive layer in layer. When a voltage is applied from a power supply to an exciting coil and an alternating current flow, magnetic flux is generated around the exciting coil and a magnetic field is formed. Magnetic coupling of a system including the heat generating roller and the exciting coil is advantageous at a low temperature and heat generation of the heat generating roller is accelerated. When the Curie point is exceeded, skin depth increases and skin resistance decreases, which suppresses generation of Joules heat and reduces heat generation of the heat generating roller.

20 Claims, 15 Drawing Sheets

U.S. PATENT DOCUMENTS

| | | | | |
|---|---|---|---|---|
| 5,778,293 | A | 7/1998 | Otsuka | 399/329 |
| 6,605,802 | B2 * | 8/2003 | Nagahira | 219/619 |
| 7,239,836 | B2 * | 7/2007 | Nanjo et al. | 399/328 |
| 2003/0147679 | A1 * | 8/2003 | Shimizu et al. | 399/328 |
| 2004/0105708 | A1 * | 6/2004 | Imai et al. | 399/330 |
| 2006/0099001 | A1 | 5/2006 | Asakura et al. | 399/69 |
| 2006/0251440 | A1 | 11/2006 | Tatematsu et al. | 399/69 |

FOREIGN PATENT DOCUMENTS

| | | |
|---|---|---|
| JP | 2001-125407 | 5/2001 |
| JP | 2004-151470 | 5/2004 |

OTHER PUBLICATIONS

English Language Abstract of JP 2004-151470.
English Language Abstract of JP 2001-125407.
English Language Abstract of JP 7-114276.

* cited by examiner (a)

(b)

HEAT GENERATING ROLLER, FIXING EQUIPMENT, AND IMAGE FORMING APPARATUS

TECHNICAL FIELD

The present invention relates to a fixing apparatus used for an image forming apparatus such as a copier, facsimile and printer based on an electrophotographic scheme or electrostatic recording scheme, and more particularly, to a fixing apparatus that heats and fixes an unfixed image to a recording material based on an electromagnetic induction heating scheme and an image forming apparatus using this fixing apparatus.

BACKGROUND ART

The adoption of an electromagnetic induction heating scheme into a fixing apparatus used for a copier, facsimile, printer or the like is actively being studied in recent years. As for the fixing apparatus based on an electromagnetic induction heating scheme, an AC current is applied to an excitation coil, and magnetic flux which repeats generation and annihilation is generated around this excitation coil. Then, an eddy current is generated when the generated magnetic flux passes through an electric conductor, and heat produced in the electric conductor by this eddy current is used for the fixing of an unfixed image.

More specifically, heat produced in the electric conductor is transferred to a nip formed by, for example, two rollers, and, when a recording material passes through the nip, toner on the recording material is fixed by the pressure of the rollers and the transferred heat. To transfer the heat produced in the electric conductor to the nip, for example, the roller which forms the nip may be formed with an electric conductor, or a thin film belt may be looped over the electric conductor and one of the rollers which form the nip.

By the way, the heat transferred to the nip is deprived by the recording material which passes through the nip and surrounding members, and the temperature of the roller or the belt which transfer the heat to the nip decreases. At this time, the width of the recording material which passes through the nip varies over a wide range, and heat is not always deprived from the whole widths of the roller and the belt uniformly.

That is, when a roller scheme whereby the roller forming the nip is formed with a electric conductor is taken as an example, the whole roller width of the heating roller formed with the electric conductor does not always contact the recording material at the nip, and, when a narrow recording material passes through the nip, heat is not deprived from a part which has no contact with the recording material. Therefore, the temperature outside the width of the recording material of the heating roller may increase excessively. When a wide recording material passes in such a condition that the temperature at that part exceeds the temperature suitable for fixing of the toner, a "hot offset" occurs, that is, the toner transferred to the recording material adheres to the heating roller again. This may also significantly shortens the life of the rubber member or the like which contacts the heating roller.

To cope with the problem of such an excessive temperature rise, it is possible to perform self temperature control using a temperature compensator alloy for which a Curie temperature is set as the electric conductor. The "Curie temperature" is a temperature which becomes a threshold for the presence/absence of magnetism of a temperature compensator alloy, and even a temperature compensator alloy which has ferromagnetism at a normal temperature loses the magnetism at a temperature exceeding the Curie temperature. Using the characteristic of such a temperature compensator alloy, it is possible to reduce an eddy current at the Curie temperature or above and suppress generation of heat by using a material whose Curie temperature is equal to a fixing temperature as the material of the conductive layer of the heat generating film as disclosed in Patent Document 1, for example.

Patent Document 1: Japanese Patent Application Laid-Open No. HEI 7-114276

DISCLOSURE OF INVENTION

Problems to be Solved by the Invention

However, a temperature compensator alloy generally has excessive skin resistance and also has large inductance upon coupling, and therefore an eddy current is hardly generated even when excited by an excitation coil. Therefore, the amount of generated heat of the temperature compensator alloy is not large, and there is a problem of requiring a warming-up time to reach a temperature necessary for fixing.

That is, an image forming apparatus such as a copier, facsimile and printer is designed to heat the fixing apparatus up to a temperature necessary for fixing toner upon power-on or recovery from a sleep state, but since the temperature rise of the temperature compensator alloy is gentle, it takes a considerable time until an image can be actually formed.

More specifically, for example, when a temperature compensator alloy having specific resistance of $70\times10^{-6}$ Ωcm (ohm centimeters) is heated through electromagnetic induction with an AC current at a frequency of 20 kHz (kilohertz), skin resistance of the temperature compensator alloy becomes 33 to $41\times10^{-4}$Ω (ohm) This value is greater than $8.8\times10^{-4}$ Ω of skin resistance of iron which is susceptible to induction heating, and inductance is also large. Therefore, an eddy current hardly flows, and the amount of generated heat is small.

Furthermore, when toner is fixed while the temperature of the fixing apparatus is not sufficiently high, the toner transferred to the recording material does not melt sufficiently, which produces a cold offset.

It is therefore an object of the present invention to provide a fixing apparatus capable of reducing a warming-up time and capable of realizing high fixing performance by preventing the occurrence of an offset, damage of a rubber member and deterioration of the life thereof by eliminating abnormally excessive temperature rises outside the width of the recording material.

Section for Solving the Problem

The fixing apparatus of the present invention adopts a configuration including:

- an excitation section to which a voltage is applied for forming a magnetic field therearound;
- a heat generating section at least a part of which is disposed in a magnetic field formed by the excitation section and that generates heat by making magnetic flux generated in the magnetic field permeate inside; and
- a fixing section that heats and fixes an image formed and carried on a recording material using heat of the heat generating section, wherein the heat generating section includes:

- a magnetically permeable conductive layer that is made of a temperature compensator material which has predetermined magnetism at a normal temperature and loses magnetism at a predetermined temperature or above; and a non-magnetic conductive layer that is laminated on the excitation section side of the magnetically permeable conductive layer.

The heating roller according to the present invention is a heating roller that is disposed in a magnetic field formed by an excitation section and generates heat by making magnetic flux generated in the magnetic field permeate inside, including:

a magnetically permeable conductive layer that is made of a temperature compensator material having predetermined magnetism at a normal temperature and losing magnetism at a temperature equal to or above a predetermined temperature; and a non-magnetic conductive layer that is laminated on the excitation section side of the magnetically permeable conductive layer.

ADVANTAGEOUS EFFECT OF THE INVENTION

According to the present invention, it is possible to reduce a warm-up time while preventing an excessive temperature rise, prevent the occurrence of an offset and realize high fixing performance.

BEST MODE FOR CARRYING OUT THE INVENTION

The inventors have discovered that fixing with heat using a temperature compensator alloy for which a Curie temperature is set requires a considerable warming-up time, and, when only the temperature compensator alloy is made to generate heat, if a part outside the width of the recording material exceeds a Curie temperature, magnetic coupling of the part improves and the amount of generated heat cannot be suppressed sufficiently.

The inventors have also noticed that even in the case of a non-magnetic material such as copper or aluminum which generally has excessively small skin resistance and in which a resistant current flows, preventing magnetic flux from penetrating the inside and making it difficult to realize electromagnetic induction heating, apparent skin resistance increases up to an appropriate value depending on the thickness, and electromagnetic induction heating becomes possible. That is, the inventors have noticed that when the thickness becomes smaller than the skin depth, apparent skin resistance Rs can be calculated from following Equation 1 using specific resistance ρ and thickness δ, and therefore apparent skin resistance increases by reducing the thickness, and electromagnetic induction heating becomes possible even for a non-magnetic material whose skin resistance is excessively small.

$$Rs=\rho/\delta \qquad \text{(Equation 1)}$$

The inventors have come up with the present invention by discovering that magnetic coupling at a temperature not higher than a Curie temperature becomes strong by laminating a thin non-magnetic material on the surface of a temperature compensator alloy, and the amount of generated heat increases compared to a case where the temperature compensator alloy or non-magnetic material is used alone.

That is, the essence of the present invention is to provide a non-magnetic conductive layer between an excitation coil and a temperature compensator alloy excited by the excitation coil, promote heat generation of the temperature compensator alloy until the temperature reaches a Curie temperature and effectively suppress excessive temperature rises outside the widths of narrow recording materials when the recording materials are successively passed.

Hereinafter, embodiments of the present invention will be explained in detail with reference to the accompanying drawings.

Embodiment 1

Figure 1:
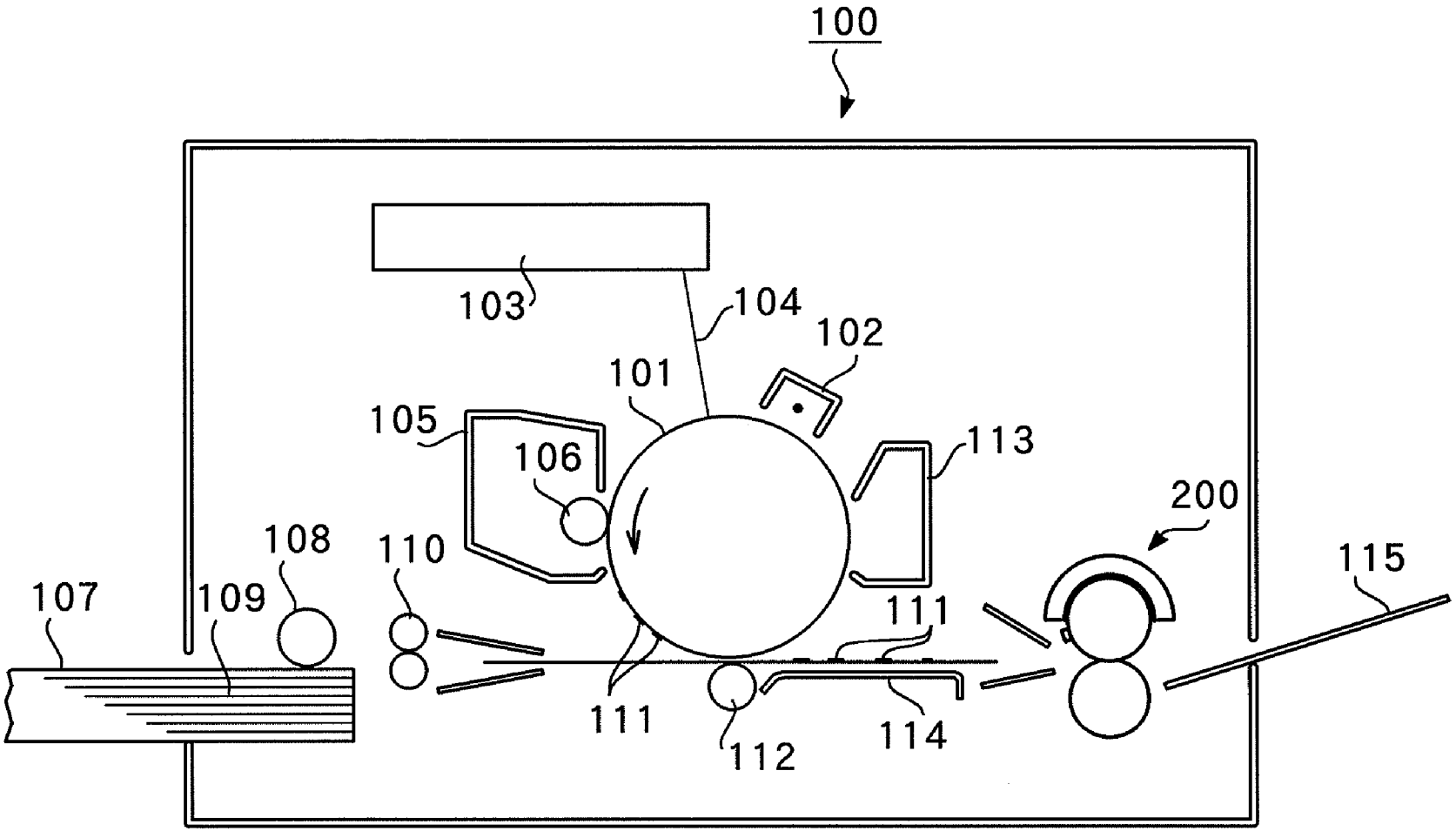
FIG. 1 illustrates a schematic configuration of an image forming apparatus according to an embodiment of the present invention.

FIG. 1 shows a schematic configuration of the image forming apparatus according to Embodiment 1 of the present invention. As shown in the same figure, image forming apparatus body 100 of this image forming apparatus is provided with electrophotographic sensitive body (hereinafter, referred to as "photosensitive drum") 101 in a freely rotatable manner. In FIG. 1, photosensitive drum 101 is driven to rotate at a predetermined circumferential velocity in the direction indicated by an arrow, and the surface thereof is uniformly charged to predetermined negative dark potential V0 by electrifier 102.

Laser beam scanner 103 outputs laser beam 104 which has been modulated according to a time series electric digital pixel signal of image information inputted from a host apparatus such as an image reading apparatus (not shown) and a computer.

The surface of uniformly charged photosensitive drum 101 is scanned with laser beam 104 and exposed thereto. This causes the absolute potential value of the exposed part of photosensitive drum 101 to decrease to light potential VL, and an electrostatic latent image is formed on the surface of photosensitive drum 101. This electrostatic latent image is inversely developed by negatively charged toner of developing device 105, and a visible image (toner image) is formed.

Developing device 105 is provided with development roller 106 which is driven to rotate. Development roller 106 is placed opposite to photosensitive drum 101, and a thin toner layer is formed on the outer surface thereof. A development bias voltage whose absolute value is smaller than dark potential V0 of photosensitive drum 101 and greater than light potential VL is applied to development roller 106. This causes the toner on development roller 106 to be transferred to only the part of light potential VL of photosensitive drum 101, causes the electrostatic latent image to become visible and unfixed toner image (hereinafter, referred to as "toner image") 111 to be formed on photosensitive drum 101.

On the other hand, recording paper 109 as a recording material is fed from paper feeding section 107 one piece at a time by feeding roller 108. Recording paper 109 which has been fed passes through a pair of resist rollers 110 and is sent to a nip between photosensitive drum 101 and transfer roller 112 at appropriate timing synchronized with the rotation of photosensitive drum 101. By this means, toner image 111 on photosensitive drum 101 is transferred to recording paper 109 by transfer roller 112 to which a transfer bias is applied.

In this way, recording paper 109 on which toner image 111 is formed and carried is guided by recording paper guide 114, separated from photosensitive drum 101 and then conveyed to a fixing area of heating fixing apparatus (hereinafter, referred to as a "fixing apparatus") 200. Fixing apparatus 200 then heats and fixes toner image 111 to recording paper 109 conveyed to this fixing area.

Recording paper 109 to which toner image 111 is fixed with heat passes through fixing apparatus 200 and is then ejected onto ejection tray 115 disposed outside image forming apparatus body 100.

Photosensitive drum 101 from which recording paper 109 has been separated is rid of the residue such as transfer remaining toner on the surface by cleaning apparatus 113 and repeatedly used for formation of subsequent images.

Figure 2:
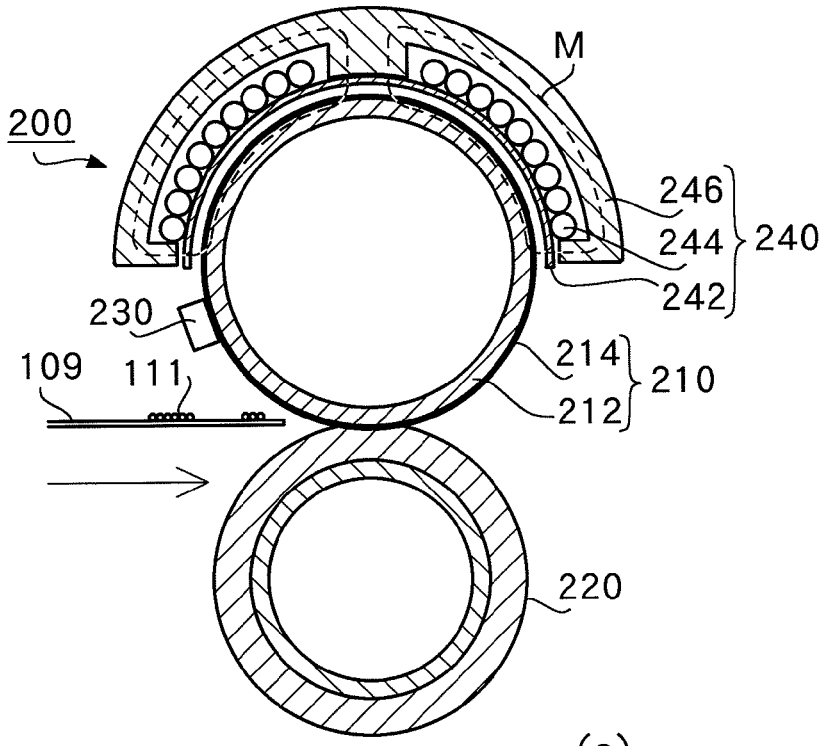
FIG. 2(*a*) is a cross-sectional view showing the configuration of a fixing apparatus according to Embodiment 1, and (b) is another cross-sectional view showing the configuration of the fixing apparatus according to Embodiment 1.
Figure 2:
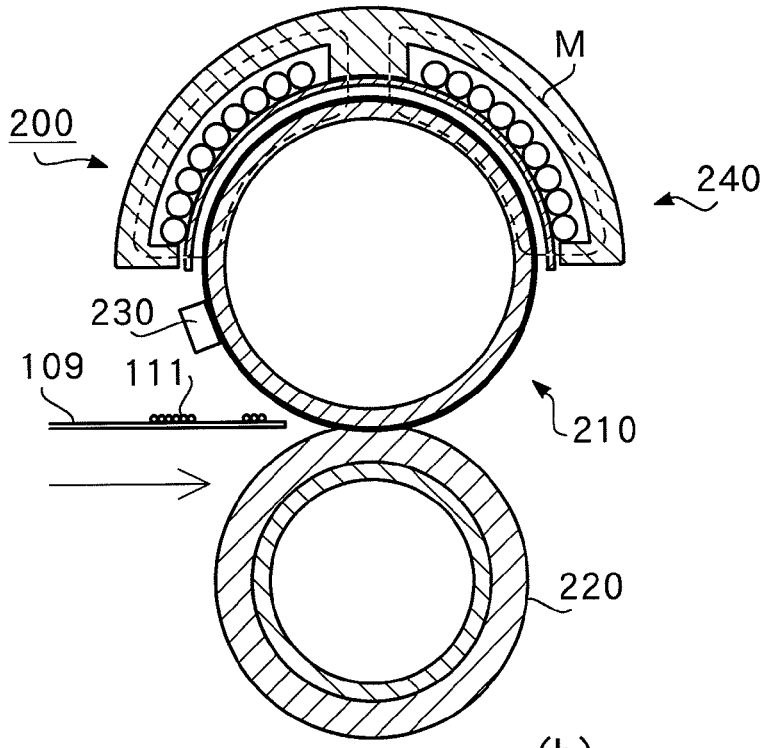

FIGS. 2(*a*) and (*b*) are cross-sectional views showing the configuration of fixing apparatus 200 according to this embodiment. FIG. 2(*a*) shows the magnetic path of magnetic flux M when the temperature is equal to or below the Curie temperature, and FIG. 2(*b*) shows the magnetic path of magnetic flux M when the temperature exceeds the Curie temperature. As shown in these figures, fixing apparatus 200 has heating roller 210, pressure roller 220, temperature sensor 230 and excitation coil unit 240.

Heating roller 210 is a cylindrical roller whose bottom surface has a diameter of, for example, 34 mm (millimeters) and rotates around the central axis so as to convey recording paper 109 on which toner image 111 is formed and carried in the direction indicated by an arrow (counterclockwise in the figure).

Figure 3:
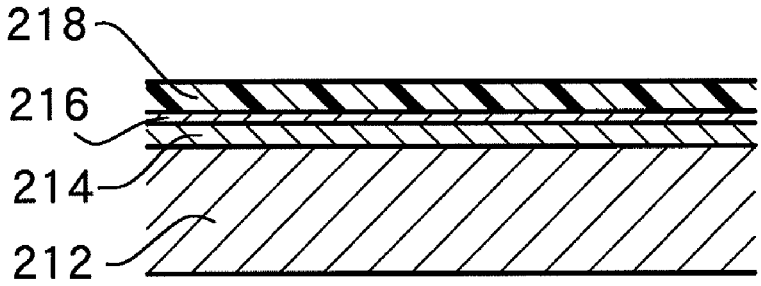
FIG. 3 is a partial cross-sectional view showing the detailed configuration of a heating roller according to Embodiment 1.

Heating roller 210 is mainly formed by laminating highly magnetically permeable conductive layer 212 and non-magnetic conductive layer 214. More specifically, as shown in FIG. 3, highly magnetically permeable conductive layer 212, non-magnetic conductive layer 214, protection nickel layer (hereinafter, referred to as "Ni layer") 216 as a protection layer and mold release layer 218 are laminated in that order from the side closest to the central axis of heating roller 210. It is preferable that the thickness of heating roller 210 corresponding to the total thickness of these layers is approximately 100 to 1000 μm (micrometers).

Highly magnetically permeable conductive layer 212 is made of a temperature compensator alloy whose Curie temperature is set to be a predetermined temperature and is formed into a cylindrical shape having a thickness of, for example, 500 μm. When the heat capacity of heating roller 210 is considered, it is preferable to make highly magnetically permeable conductive layer 212 thinner to reduce the heat capacity and rapidly increase the temperature of heating roller 210. However, when a Curie temperature is exceeded, as shown in FIG. 2(*b*), the skin depth—the depth that magnetic flux M permeates heating roller 210—increases, so that, when highly magnetically permeable conductive layer 212 is excessively thin, the magnetic flux may penetrate this layer and heat surrounding members other than heating roller 210. Moreover, this may also produce a problem of, for example, causing damage to members vulnerable to high heat such as a bearing that supports heating roller 210 around a shaft. Therefore, highly magnetically permeable conductive layer 212 need to be made thicker than the skin depth of the temperature compensator alloy which forms this layer. More specifically, it is preferable that the thickness of highly magnetically permeable conductive layer 212 is 300 μm to 1000 μm.

As the temperature compensator alloy which forms highly magnetically permeable conductive layer 212, for example, an alloy of iron and nickel or an alloy of iron, nickel and chromium is used. By adjusting the composition of the respective metals, the Curie temperature of the temperature compensator alloy can be set to a predetermined temperature. In this embodiment, it is assumed that the Curie temperature of the temperature compensator alloy which forms highly magnetically permeable conductive layer 212 is set to 220 degrees which is close to the fixing temperature of the toner. Therefore, highly magnetically permeable conductive layer 212 exhibits a characteristic as a ferromagnetic material when the temperature is equal to or below 220 degrees, and exhibits a characteristic as a non-magnetic substance when the temperature exceeds 220 degrees. The Curie temperature is not limited to 220 degrees and may also be set to a lower temperature.

Non-magnetic conductive layer 214 is made of a non-magnetic material such as copper and is a layer of 5 m in thickness which is subjected to plating, metalizing or processing using a clad material formed on the outer surface of highly magnetically permeable conductive layer 212. The material of non-magnetic conductive layer 214 preferably has specific resistance of $10\times10^{-6}$ Ωcm or below, and aluminum, silver or gold may be used in addition to copper. Furthermore, it is preferable that the thickness of non-magnetic conductive layer 214 is approximately 2 to 30 μm. From the viewpoint of heat capacity, since the amount of generated heat decreases when the thickness exceeds 30 μm, it is preferable to also reduce the thickness of non-magnetic conductive layer 214 to reduce the heat capacity as in the case of highly magnetically permeable conductive layer 212 as described above. On the other hand, when the thickness is smaller than 2 μm, the substantial resistance thereof becomes excessive, the occurrence of an eddy current is obstructed, and the amount of generated heat decreases.

Ni layer 216 is a nickel layer having a thickness of, for example, 2 m which is subjected to plating, metalizing or processing using a clad material formed on the outer surface of non-magnetic conductive layer 214. By covering the surface of non-magnetic conductive layer 214, Ni layer 216 prevents oxidation of non-magnetic conductive layer 214 and improves durability and also improves adherence of mold release layer 218 and prevents delamination. In the present invention, it is also possible to form a protection layer having a thickness of 2 to 10 μm using chromium and zinc or the like instead of Ni layer 216. When the thickness of the protection layer falls below 2 μm, it may not sufficiently function as the protection layer. On the other hand, when the thickness exceeds 10 μm, the heat capacity of the protection layer increases, and it requires more time for warm-up.

Mold release layer 218 is made of fluororesin such as PTFE, PFA or FEP and is a layer having a thickness of, for example 20m, formed on the outer surface of heating roller 210.

It is possible to provide a silicon rubber layer between Ni layer 216 and mold release layer 218 and provide heating roller 210 with elasticity.

Referring to FIGS. 2(*a*) and (*b*) again, pressure roller 220 is pressed against heating roller 210 and forms a nip through which recording paper 109 passes. Then, pressure roller 220 follows the rotation of heating roller 210 and rotates (clockwise in the figure) around the central axis so as to convey recording paper 109 in the direction indicated by an arrow. Here, it is assumed that pressure roller 220 follows the rotation of heating roller 210, but it is also possible to make pressure roller 220 rotate and make heating roller 210 follow pressure roller 220.

Furthermore, pressure roller 220 is formed with a material having small heat conduction such as, for example, silicon rubber having JISA hardness of 30 degrees. As the material of pressure roller 220, it is possible to use, for example, heat-resistant resin such as fluororubber and fluororesin or other rubber. Furthermore, to increase abrasion resistance and mold releasability, it is preferable to cover the outer surface of pressure roller 220 by using resin such as PTFE, PFA or FEP and rubber singly or in combination.

Temperature sensor 230 is provided downstream in the rotation direction of heating roller 210 with respect to excitation coil unit 240 in contact with the outer surface of heating roller 210 to detect the temperature of heating roller 210. Once the temperature of heating roller 210 is detected by temperature sensor 230, for example, a control section (not shown) instructs feeding roller 108 to start the feeding of recording paper 109 or controls the supply of an AC current from a power supply (not shown) to excitation coil unit 240. More specifically, when temperature sensor 230 detects that the temperature of heating roller 210 has become a temperature appropriate to the fixing of toner image 111, the control section (not shown) instructs feeding roller 108 to start the operation, and printing is started. On the other hand, when temperature sensor 230 detects that the temperature of heating roller 210 became higher than a predetermined threshold, the supply of an AC current from the power supply (not shown) to excitation coil unit 240 is controlled.

Excitation coil unit 240 has coil holding member 242, excitation coil 244 and core member 246.

Coil holding member 242 is formed with semi-cylindrical insulator disposed opposite to the outer surface of the upper half of heating roller 210.

Excitation coil 244 is formed by winding a conductor around the opposite side of the surface of coil holding member 242 facing heating roller 210, and, when a voltage is applied from a power supply (not shown), and an AC current flows, generates magnetic flux around and forms a magnetic field.

Core member 246 is formed with a magnetic material having high magnetic permeability and specific resistance such as ferrite and permalloy and disposed so as to cover excitation coil 244.

More specifically, core member 246 contacts coil holding member 242 at the center of the winding of the conductor making up excitation coil 244 and at the outermost edges of the winding, and is disposed substantially parallel to coil holding member 242 across excitation coil 244 in other parts. Core member 246 constitutes a magnetic path for magnetic flux generated opposite to heating roller 210 out of the magnetic flux generated by excitation coil 244.

Excitation coil unit 240 according to this embodiment excites heating roller 210 from the outside of heating roller 210, and therefore this improves the operation efficiency of replacement and maintenance of parts such as heating roller 210 which is consumable.

Next, the principle of heat generation of fixing apparatus 200 configured as described above will be explained.

First, a case where the temperature of heating roller 210 is equal to or lower than the Curie temperature will be explained. When the power of the image forming apparatus is turned off or in a sleep state, the temperature of heating roller 210 of fixing apparatus 200 generally continues to fall down to a room temperature, much lower than 220 degrees which is the Curie temperature of this embodiment. When the power is turned on to perform printing or the system is recovered from a sleep state, the temperature of heating roller 210 increases to a temperature appropriate to fixing of toner image 111.

That is, a voltage is applied to excitation coil 244 of excitation coil unit 240 from a power supply (not shown), and an AC current flows. It is preferable that the frequency of this AC current is 20 to 100 kHz. In this embodiment, this frequency is set to 20 to 60 kHz. When an AC current flows through excitation coil 244, magnetic flux M is generated around excitation coil 244 as shown in FIG. 2(*a*). Generated Magnetic flux M penetrates non-magnetic conductive layer 214 of heating roller 210, reaches highly magnetically permeable conductive layer 212 and permeates near the outer surface of highly magnetically permeable conductive layer 212 through a skin effect. This produces an eddy current for canceling out magnetic flux M in non-magnetic conductive layer 214 and near the outer surface of highly magnetically permeable conductive layer 212, and non-magnetic conductive layer 214 and highly magnetically permeable conductive layer 212 are heated with Joule heat.

Though details will be explained later, since heating roller 210 is formed by laminating highly magnetically permeable conductive layer 212 and non-magnetic conductive layer 214 in this embodiment, magnetic coupling of the system which consists of heating roller 210 and excitation coil 244 is improved, and heat generation of heating roller 210 is promoted.

On the other hand, when the temperature of heating roller 210 rises and exceeds the Curie temperature, highly magnetically permeable conductive layer 212 becomes non-magnetic and the skin depth increases as shown in FIG. 2(*b*), and magnetic flux M permeates up to near the inner surface of highly magnetically permeable conductive layer 212. Since the skin resistance is inversely proportional to the skin depth according to the Equation 1 described above, the skin resistance decreases when the temperature exceeds the Curie temperature, the occurrence of Joule heat is restrained, and the amount of generated heat of heating roller 210 decreases.

Next, the behavior of parameters relating to heat generation at fixing apparatus 200 in this embodiment will be explained.

Figure 4:
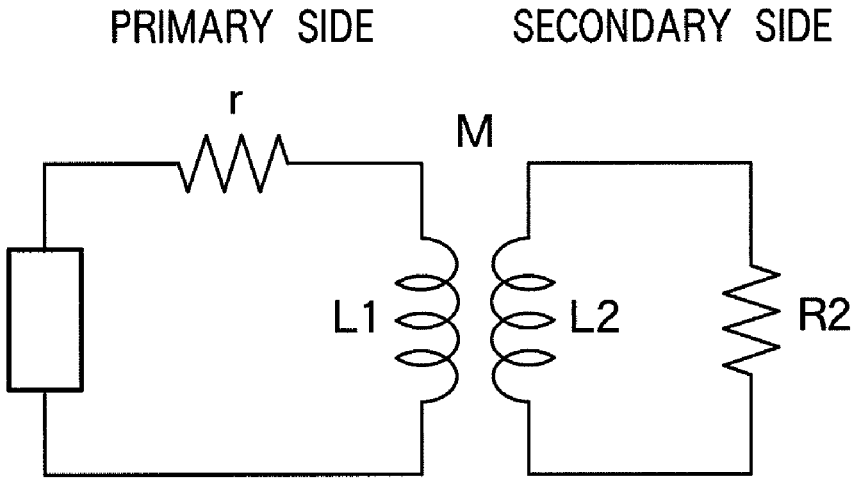
FIG. 4 shows an equivalent circuit of a system made up of the heating roller and excitation coil according to Embodiment 1.

The system made up of heating roller 210 and excitation coil 244 according to this embodiment can be expressed as shown in an equivalent circuit in FIG. 4 by resistance r and inductance L1 of excitation coil 244 (primary side), resistance R2 and inductance L2 of heating roller 210 (secondary side) which electromagnetically couples with this excitation coil 244 and mutual inductance M of the primary side and the secondary side. Coupling coefficient k which expresses the quality of magnetic coupling of the primary side and the secondary side can be expressed by Equation 2.

$$k=M/(L1\cdot L2)^{1/2} \quad \text{(Equation 2)}$$

Figure 5:
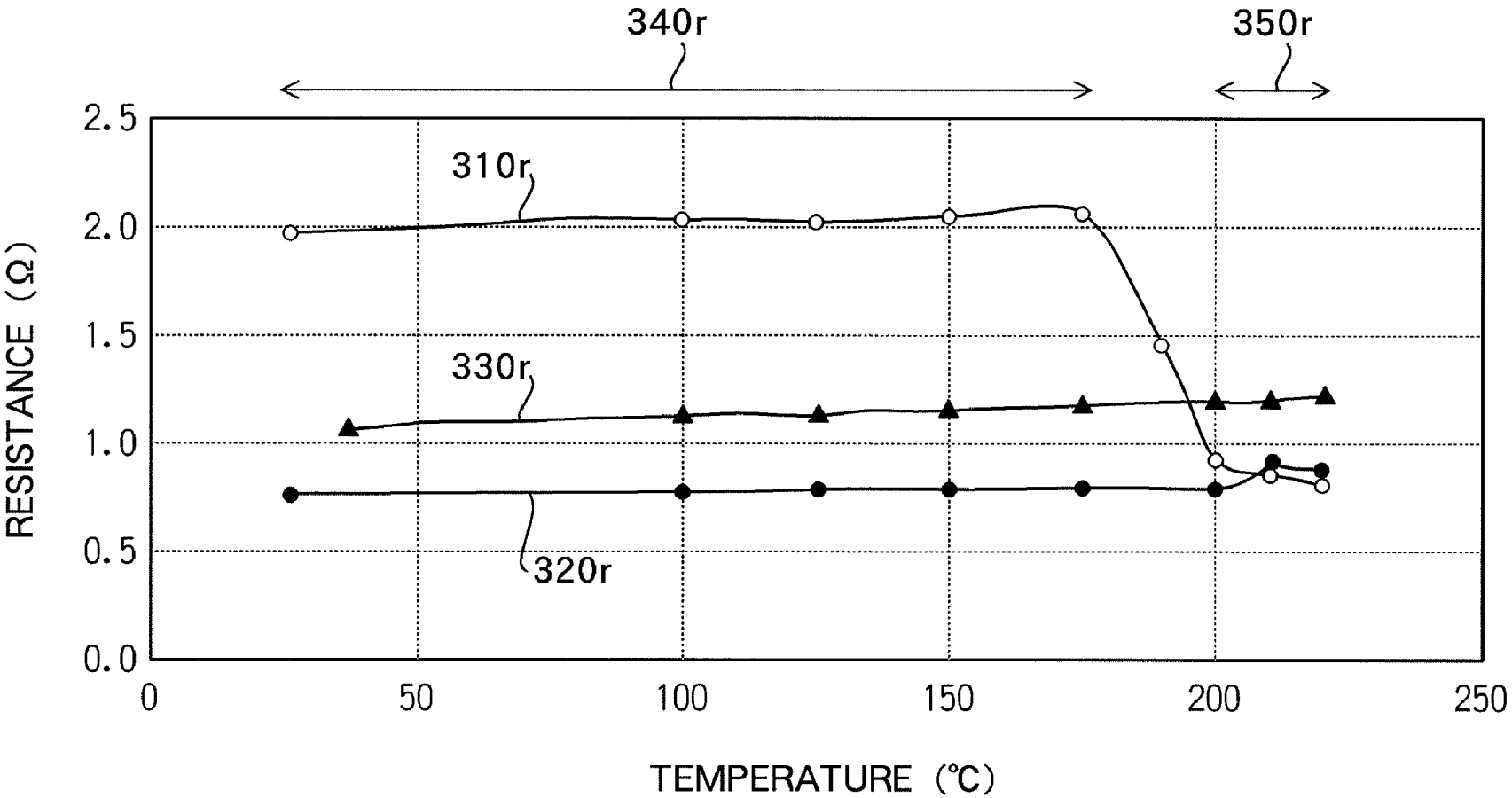
FIG. 5 shows a variation of resistance R of the equivalent circuit according to Embodiment 1.
Figure 6:
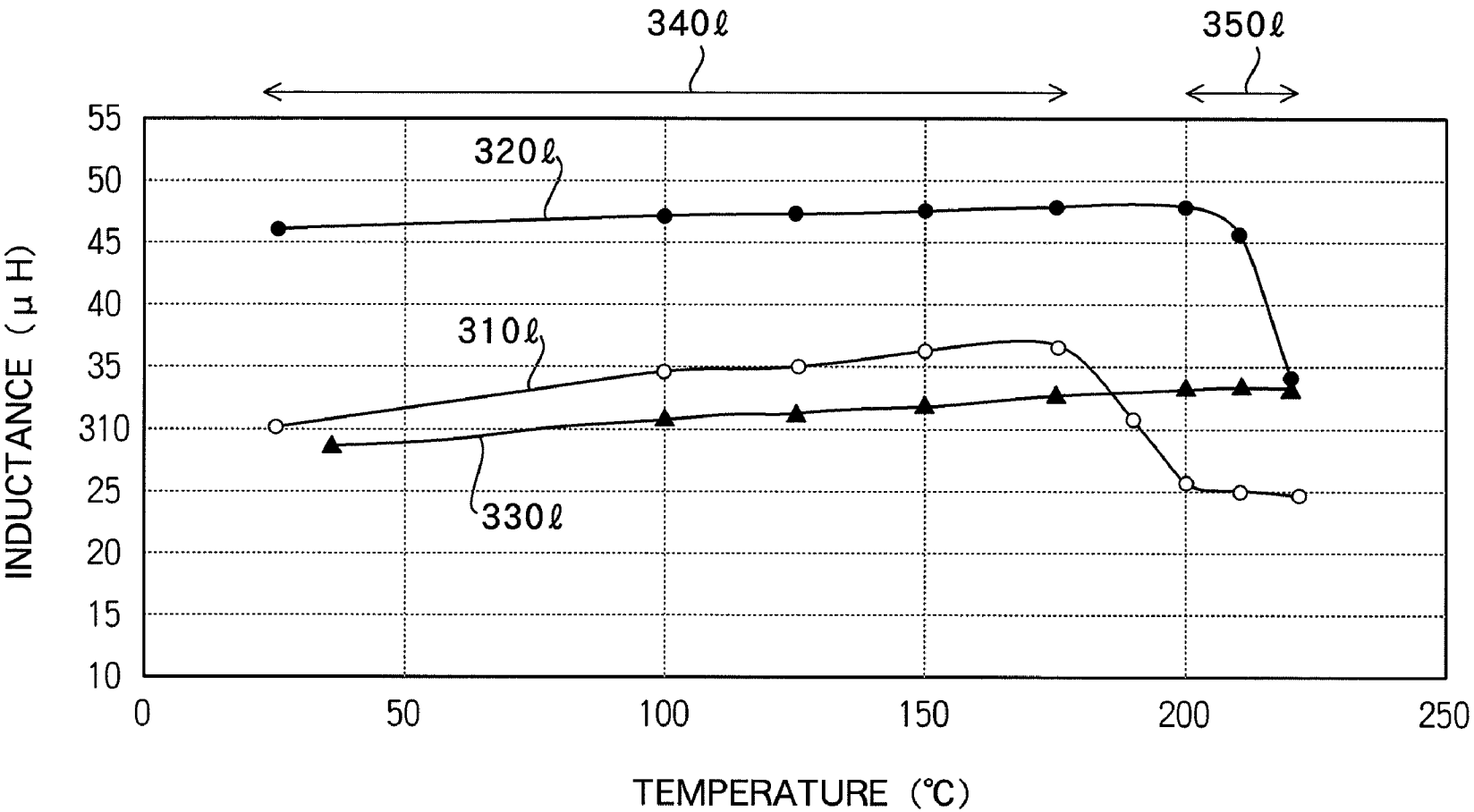
FIG. 6 shows a variation of inductance L of the equivalent circuit according to Embodiment 1.
Figure 7:
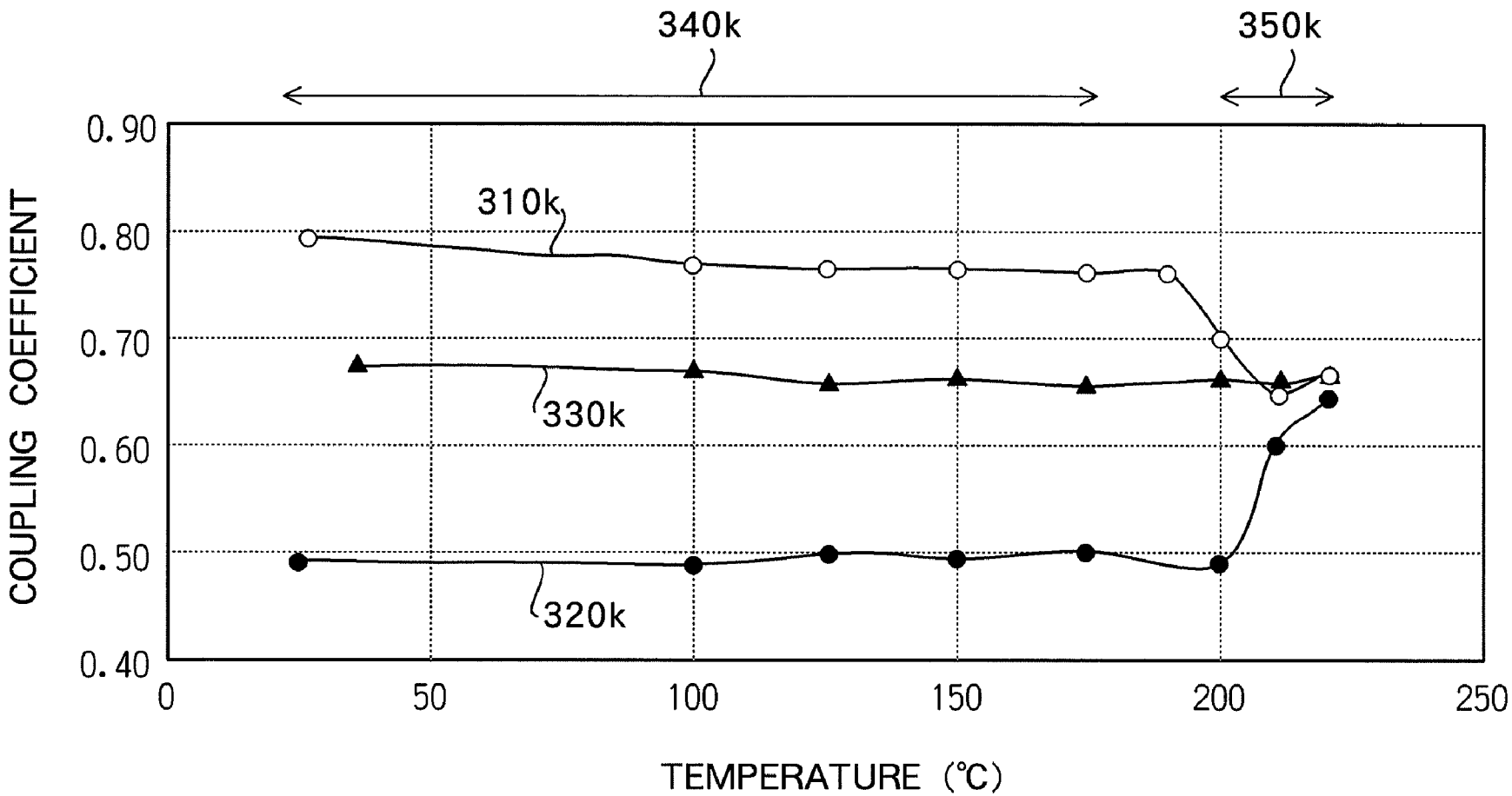
FIG. 7 shows a variation of coupling coefficient k of the equivalent circuit according to Embodiment 1.

Furthermore, assuming that combined resistance of the primary and secondary sides is R and combined inductance is L, measured values of these temperature characteristics are shown in FIG. 5 and subsequent figures. FIG. 5 shows measured values of the temperature and resistance R of heating roller 210 at frequency 20 kHz of an AC current, FIG. 6 shows measured values of the temperature and inductance L of heating roller 210 at frequency 20 kHz of an AC current. Furthermore, FIG. 7 shows the correspondence between the temperature and coupling coefficient k of heating roller 210 at frequency 20 kHz of an AC current.

In FIG. 5, curve 310*r* plotted with white circles indicates resistance R according to this embodiment. Furthermore, curve 320*r* plotted with black circles indicates the resistance when the temperature compensator alloy is used alone for the heating roller, and curve 330*r* plotted with black triangles indicates the resistance when iron is used for the heating roller.

As shown in the figure, in section 340*r* in which the temperature is equal to or below the Curie temperature, resistance R according to this embodiment is fixed to approximately 2.0 Ω, which is bigger than the resistance of the temperature compensator alloy alone or iron. This means that more Joule heat is generated at heating roller 210, and heat generation is promoted more than when the temperature compensator alloy alone or iron is used for the heating roller.

On the other hand, in section 350*r* in which the temperature is equal to or above the Curie temperature, it can be understood that resistance R falls down to a level equivalent to the resistance of the temperature compensator alloy alone and that the amount of generated heat decreases drastically. On the contrary, the resistance of the temperature compensator alloy alone hardly changes in section 350*r*. Furthermore, since the Curie temperature of iron is as very high as 769 degrees, the resistance never changes drastically in section 350*r*, and the amount of generated heat does not decrease.

In FIG. 6, curve 3101 plotted with white circles indicates inductance L according to this embodiment. On the other hand, curve 3201 plotted with black circles indicates inductance when the temperature compensator alloy alone is used for the heating roller, and curve 3301 plotted with black triangles indicates inductance when iron is used for the heating roller.

As shown in the same figure, in section 3401 in which the temperature is equal to or below the Curie temperature, inductance L according to this embodiment is 30 μH (microhenry) to approximately 37 μH and is smaller than inductance of the temperature compensator alloy alone which is equal to or above 45 μH. From this, it can be understood that power can be supplied more easily than when the temperature compensator alloy is used alone for the heating roller.

On the other hand, in section 3501 in which the temperature is equal to or above the Curie temperature, both inductance L and inductance of the temperature compensator alloy alone decrease and approximate to the same value. Furthermore, inductance of iron increases gradually in accordance with an increase of the temperature.

In FIG. 7, curve 310*k* plotted with white circles indicates coupling coefficient k according to this embodiment. On the other hand, curve 320*k* plotted with black circles indicates the coupling coefficient when the temperature compensator alloy is used alone for the heating roller, and curve 330*k* plotted with black triangles indicates the coupling coefficient when iron is used for the heating roller.

As shown in the same figure, in section 340*k* in which the temperature is equal to or below the Curie temperature, coupling coefficient k is approximately 0.80, which is greater than the coupling coefficient of the temperature compensator alloy alone or iron. This means that the magnetic coupling of the system which consists of heating roller 210 and excitation coil 244 is good, and heat is generated more efficiently than when the temperature compensator alloy alone or iron is used for the heating roller.

On the other hand, in section 350*k* in which the temperature is equal to or above the Curie temperature, it can be understood that coupling coefficient k decreases down to a level equivalent to the coupling coefficient of the temperature compensator alloy alone or iron and that the efficiency of heat generation deteriorates. Therefore, in section 350*k*, the amount of generated heat of heating roller 210 decreases and thereby restrains a temperature rise. On the contrary, it can be understood that the coupling coefficient of the temperature compensator alloy alone rather tends to increase in section 350*k*, and the efficiency of heat generation improves when the temperature exceeds the Curie temperature. Furthermore, the coupling coefficient of iron does not change drastically in accordance with an increase of the temperature and is stable at approximately 0.65 to 0.70.

As described above, when the temperature variation of parameters of heating roller 210 formed by laminating highly magnetically permeable conductive layer 212 and non-magnetic conductive layer 214 is compared to that of the heating roller using the temperature compensator alloy alone, it can be understood that values in both cases indicate that heating roller 210 is more likely to generate heat when the temperature is lower than the Curie temperature. In other words, by laminating non-magnetic conductive layer 214 on highly magnetically permeable conductive layer 212 which is a temperature compensator alloy, it is possible to promote heat generation of heating roller 210 for a period of low temperature and shorten a warm-up time of fixing apparatus 200 for increasing the temperature of whole fixing roller 210 from a normal temperature to the fixing temperature which is equal to or below the Curie temperature compared to the case where the temperature compensator alloy is used alone.

Furthermore, when the temperature of heating roller 210 rises close to the Curie temperature, resistance R and coupling coefficient k decrease and thereby restrain heat generation of roller 210. On the contrary, when the temperature compensator alloy is used alone, since there is little variation in resistance R, the coupling coefficient increases, so that it can be understood that the amount of generated heat of the temperature compensator alloy hardly decreases. In other words, when narrow recording materials are passed successively, if the temperature outside the width of the recording material rises and approximates to the Curie temperature, the temperature compensator alloy in this part becomes non-magnetic, magnetic flux thereof decreases, and thereby restrains heat generation. However, since non-magnetic conductive layer 214 is laminated on highly magnetically permeable conductive layer 212 which is the temperature compensator alloy in this case, heat generation is restrained more strongly than the case with the temperature compensator alloy alone. As a result, it is possible to significantly expand the difference in the amount of generated heat between the part within the width of the recording material whose temperature is below the Curie temperature and the part outside the width of the recording material whose temperature approximates to the Curie temperature, so that it is possible to suppress the amount of heat generated outside the width of the recording material to a minimum, reliably suppress an excessive temperature rise and prevent the occurrence of a hot offset and damage and deterioration of the life of members vulnerable to high heat around heating roller 210.

In this way, according to this embodiment, the excitation coil excites the heating roller formed by laminating a highly magnetically permeable conductive layer made of a temperature compensator alloy whose Curie temperature is set to a fixing temperature of toner and a non-magnetic conductive layer, so that heat generation is promoted for a period of low temperature which is equal to or below the Curie temperature more than when the temperature compensator alloy is excited alone, and heat generation is restrained for a period of a high temperature close to the Curie temperature. Therefore, it is possible to prevent an excessive temperature rise of the fixing apparatus, shorten the warm-up time, prevent the occurrence of an offset and thereby realize high fixing performance.

Embodiment 2

A feature of Embodiment 2 of the present invention is to arrange a non-magnetic electric conductor inside a heating roller to effectively prevent an excessive temperature rise in the part when the temperature of the heating roller partially approximates to a Curie temperature, and reduce the thickness of a highly magnetically permeable conductive layer of the heating roller to shorten a warm-up time.

Since the schematic configuration of the image forming apparatus according to this embodiment is similar to that of Embodiment 1 (FIG. 1), explanations thereof will be omitted. In this embodiment, only the configuration of fixing apparatus 200 is different from that of Embodiment 1.

Figure 8:
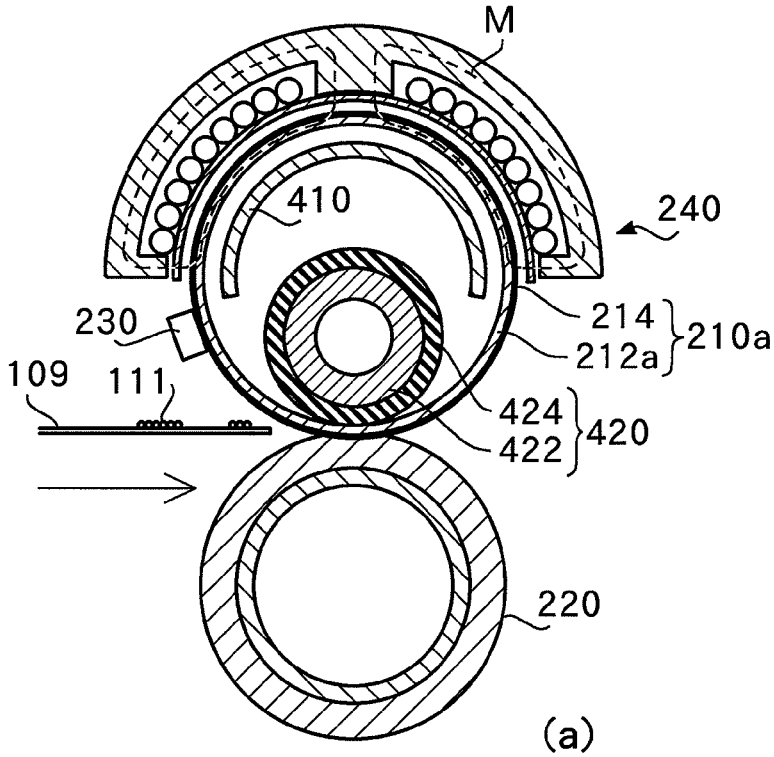
FIG. 8(*a*) is a cross-sectional view showing the configuration of a fixing apparatus according to Embodiment 2 of the present invention, and (b) is another cross-sectional view showing the configuration of the fixing apparatus according to Embodiment 2.
Figure 8:
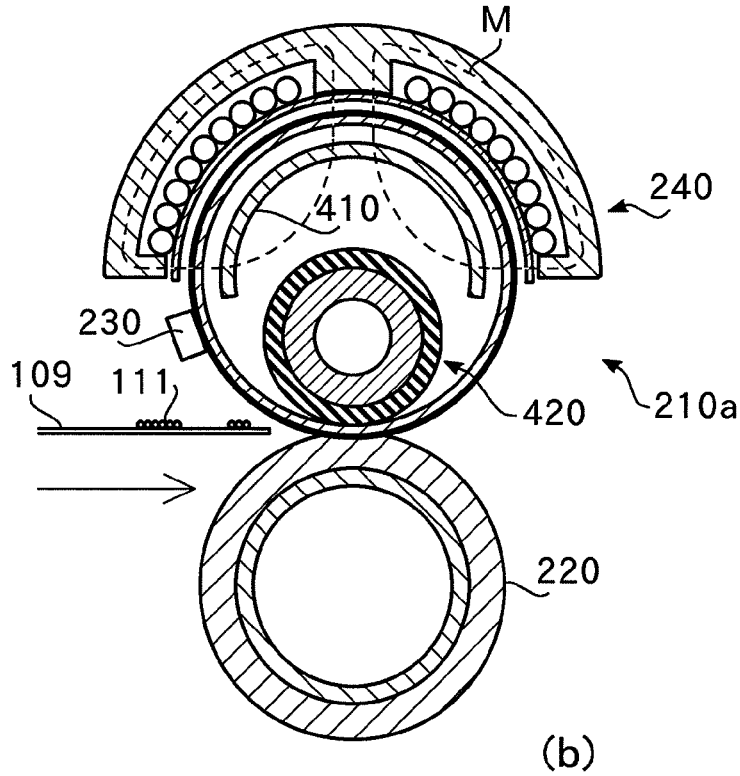

FIGS. 8(*a*) and (*b*) are cross-sectional views showing the configuration of fixing apparatus 200 according to this embodiment. FIG. 8(*a*) shows a magnetic path of magnetic flux M when the temperature is equal to or below a Curie temperature, and FIG. 8(*b*) shows a magnetic path of magnetic flux M when the temperature exceeds a Curie temperature. In these figures, parts that are identical with ones in fixing apparatus 200 (FIG. 2) according to Embodiment 1 will be assigned the same reference numerals without further explanations. Fixing apparatus 200 according to this embodiment adopts a configuration substituting heating roller 210*a* for heating roller 210 of fixing apparatus 200 according to Embodiment 1 and adding non-magnetic electric conductor 410 and auxiliary roller 420.

Heating roller 210*a* is a cylindrical roller whose bottom surface has a diameter of, for example, 34 mm and rotates around the central axis (counterclockwise in the figure) so as to convey recording paper 109 on which toner image 111 is formed and carried in the direction indicated by an arrow.

Furthermore, heating roller 210*a* is formed by mainly laminating highly magnetically permeable conductive layer 212*a* and non-magnetic conductive layer 214, but the thickness of highly magnetically permeable conductive layer 212*a* is different from that of Embodiment 1. The other layers are similar to those of heating roller 210 (FIG. 3) of Embodiment 1.

That is, highly magnetically permeable conductive layer 212*a* is formed into a cylindrical shape having a thickness of, for example, 200 μm. Since highly magnetically permeable conductive layer 212*a* is thinner than highly magnetically permeable conductive layer 212 of Embodiment 1, it is possible to increase the temperature of heating roller 210*a* rapidly from the above-described viewpoint of heat capacity. It is preferable that the thickness of highly magnetically permeable conductive layer 212*a* is 100 to 700 μm.

Non-magnetic electric conductor 410 is made of a semi-cylindrical non-magnetic material of, for example, 500 μm in thickness and is disposed opposite to excitation coil unit 240 across the peripheral surface of heating roller 210*a*. As the material of non-magnetic electric conductor 410, for example, copper, aluminum, silver or gold can be used as in the case of the material in non-magnetic conductive layer 214. As shown in FIG. 8(*b*) when the temperature of heating roller 210*a* exceeds a Curie temperature, the skin depth increases, and magnetic flux M penetrates heating roller 210*a*, an eddy current is generated in non-magnetic electric conductor 410 in the direction in which magnetic flux M attenuates, which drastically reduces magnetic flux in the part of heating roller 210*a* that exceeds the Curie temperature and can thereby prevent an excessive temperature rise. Therefore, even when the thickness of highly magnetically permeable conductive layer 212*a* is reduced, magnetic flux M which has penetrated heating roller 210*a* does not heat surrounding members such as auxiliary roller 420. Since the heat capacity of heating roller 210*a* becomes small, it is further possible to promote heat generation of heating roller 210*a*.

Furthermore, it is preferable that the thickness of non-magnetic electric conductor 410 is approximately 200 to 2000 μm. This reason will be explained below.

Figure 9:
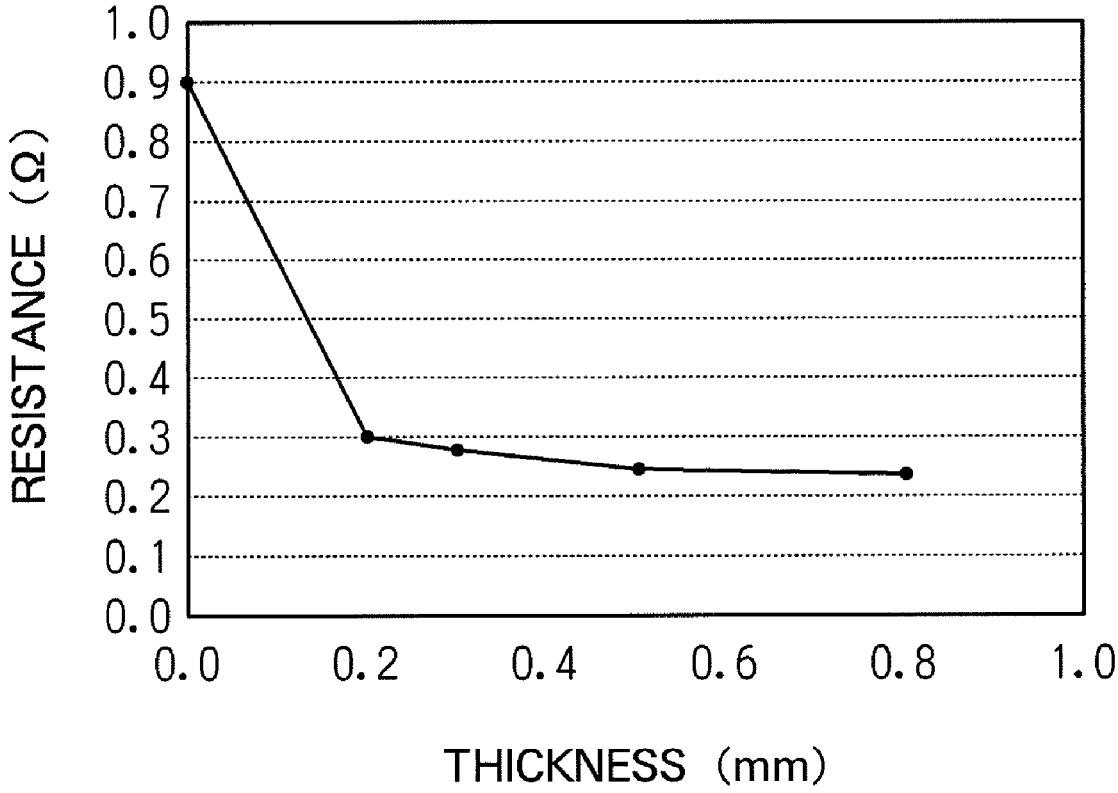
FIG. 9 shows a relationship between the thickness of a non-magnetic electric conductor and the resistance of an equivalent circuit according to Embodiment 2.

FIG. 9 shows resistance R of an equivalent circuit of a system made up of heating roller 210*a* and excitation coil 244 when the frequency of an AC current is 20 kHz and the thickness of non-magnetic electric conductor 410 is changed. However, the figure shows resistance R when copper is used for non-magnetic electric conductor 410 and the temperature of heating roller 210*a* is as high as close to the Curie temperature. When the temperature of heating roller 210*a* is as high as close to the Curie temperature, it is preferable that heat generation is suppressed, and therefore the thickness of non-magnetic electric conductor 410 is preferably such a value that can reduce resistance R to the lowest possible level.

Referring to FIG. 9, when non-magnetic electric conductor 410 is not disposed inside heating roller 210*a* (when the thickness is 0 mm), resistance R is approximately 0.9 Ω. On the other hand, when the thickness of non-magnetic electric conductor 410 is 0.2 mm (=200 μm) resistance R drastically decreases down to approximately 0.3 Ω. Even when the thickness is equal to or above 0.2 mm, resistance R does not change so much.

Therefore, if the thickness of non-magnetic electric conductor 410 is at least approximately 0.2 mm, heat generation can be restrained for a period of a high temperature close to the Curie temperature.

On the other hand, if the thickness of non-magnetic electric conductor 410 is excessively increased, heat is deprived from heating roller 210*a* and heat generation of heating roller 210*a* is obstructed, and therefore it is preferable that the thickness is set to approximately 2000 μm at maximum.

Auxiliary roller 420 is formed with rubber layer 424 made of high heat insulating silicon rubber formed on the surface of cored bar 422. In this embodiment, since heating roller 210*a* becomes thin and mechanical strength thereof becomes weak, heating roller 210*a* may be deformed through contact under pressure with pressure roller 220. To prevent this, rotatable auxiliary roller 420 is disposed in such a way that heating roller 210*a* is pressed from inside at the nip. Auxiliary roller 420 is not limited to this mode and can also be configured with a fixed pressure plate or the like, and it is preferable that the contact with heating roller 210*a* has a high heat insulating characteristic.

Next, the principle of heat generation of fixing apparatus 200 configured as described above will be explained.

In the case where the temperature of heating roller 210*a* is equal to or below a Curie temperature in this embodiment, when an AC current flows through excitation coil 244, magnetic flux M is generated around excitation coil 244 as shown in FIG. 8(*a*). Generated magnetic flux M penetrates non-magnetic conductive layer 214 of heating roller 210*a*, reaches highly magnetically permeable conductive layer 212*a* and permeates near the outer surface of highly magnetically permeable conductive layer 212*a* through a skin effect. This produces an eddy current in a direction in which magnetic flux M is canceled out in non-magnetic conductive layer 214 and near the outer surface of highly magnetically permeable conductive layer 212*a*, and non-magnetic conductive layer 214 and highly magnetically permeable conductive layer 212*a* are heated with Joule heat.

On the other hand, in the case where the temperature of heating roller 210*a* rises and exceeds the Curie temperature, highly magnetically permeable conductive layer 212*a* becomes non-magnetic, and magnetic flux M penetrates this layer as shown in FIG. 8(*b*) Magnetic flux M which has penetrated highly magnetically permeable conductive layer 212*a* permeates non-magnetic electric conductor 410 and causes an opposite magnetic field and reduces magnetic flux. As a result, since the occurrence of an eddy current at heating roller 210*a* is also restrained and the resistance of the whole system is small for a period of high temperature as described above, the amount of generated heat of heating roller 210*a* decreases substantially. At this time, since non-magnetic electric conductor 410 is made of a material having small specific resistance and is also thick, the skin resistance is small, and the amount of generated heat is small.

As will be explained in detail later, since non-magnetic electric conductor 410 is provided inside heating roller 210*a* in this embodiment, magnetic coupling when the temperature exceeds a Curie temperature becomes weak, and heat generation of heating roller 210*a* is restrained more strongly. As a result, especially when narrow recording materials are passed successively or the like, it is possible to effectively prevent the temperature of heating roller 210*a* outside the paper material from increasing extraordinarily.

Next, the behavior of parameters relating to heat generation of fixing apparatus 200 in this embodiment will be explained.

Figure 10:
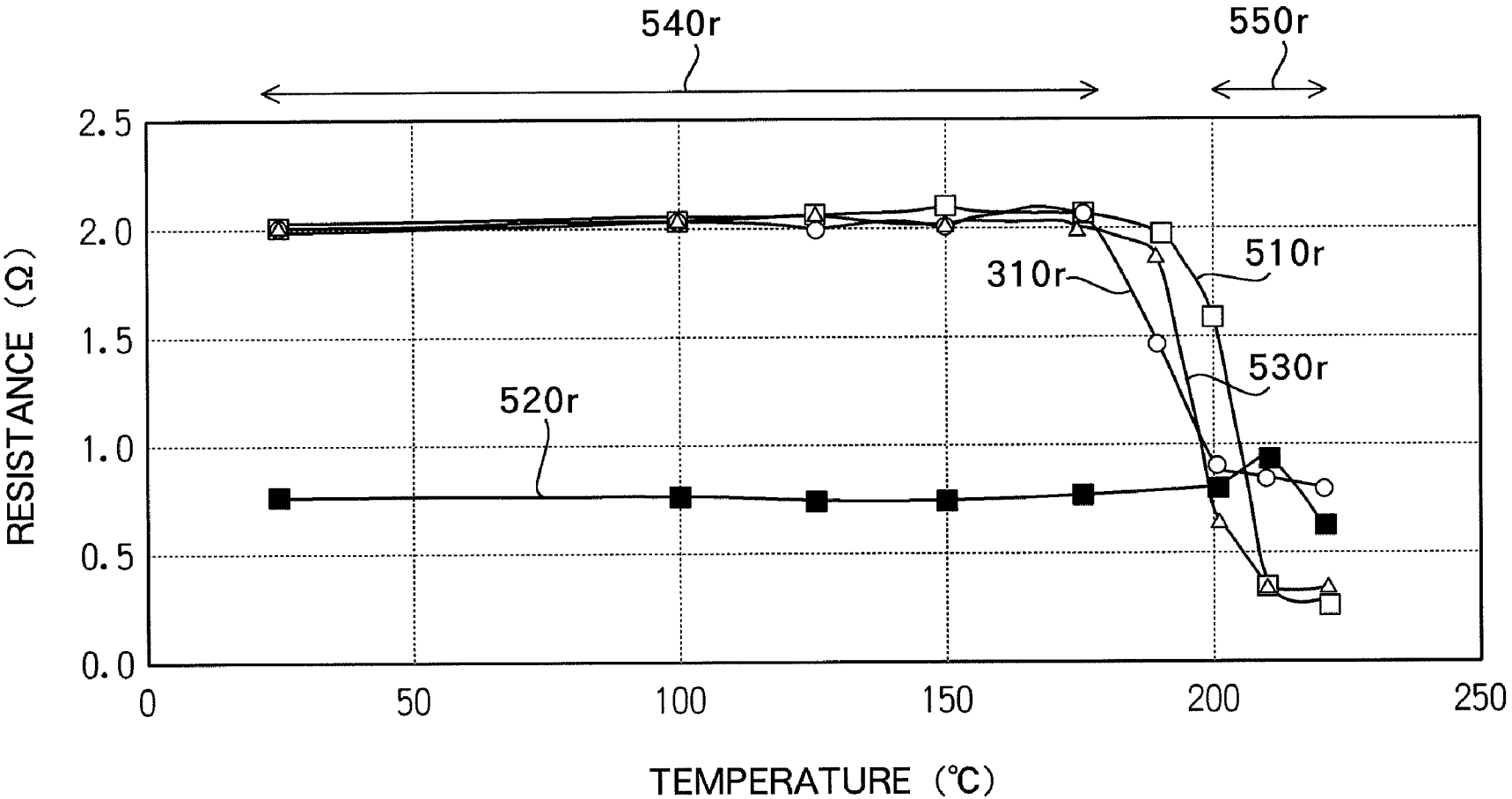
FIG. 10 shows a variation of resistance R of the equivalent circuit according to Embodiment 2.
Figure 11:
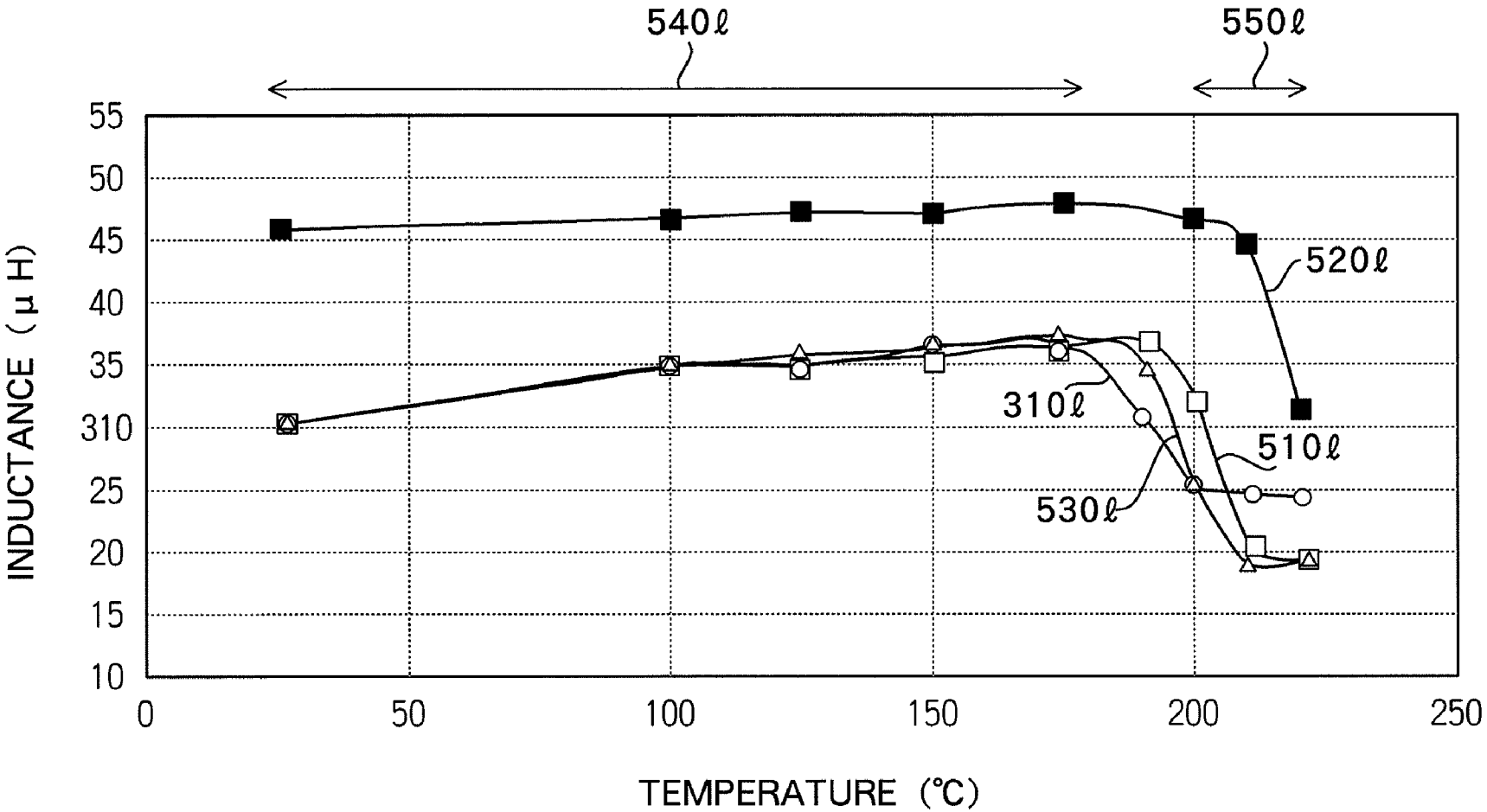
FIG. 11 shows a variation of inductance L of the equivalent circuit according to Embodiment 2.
Figure 12:
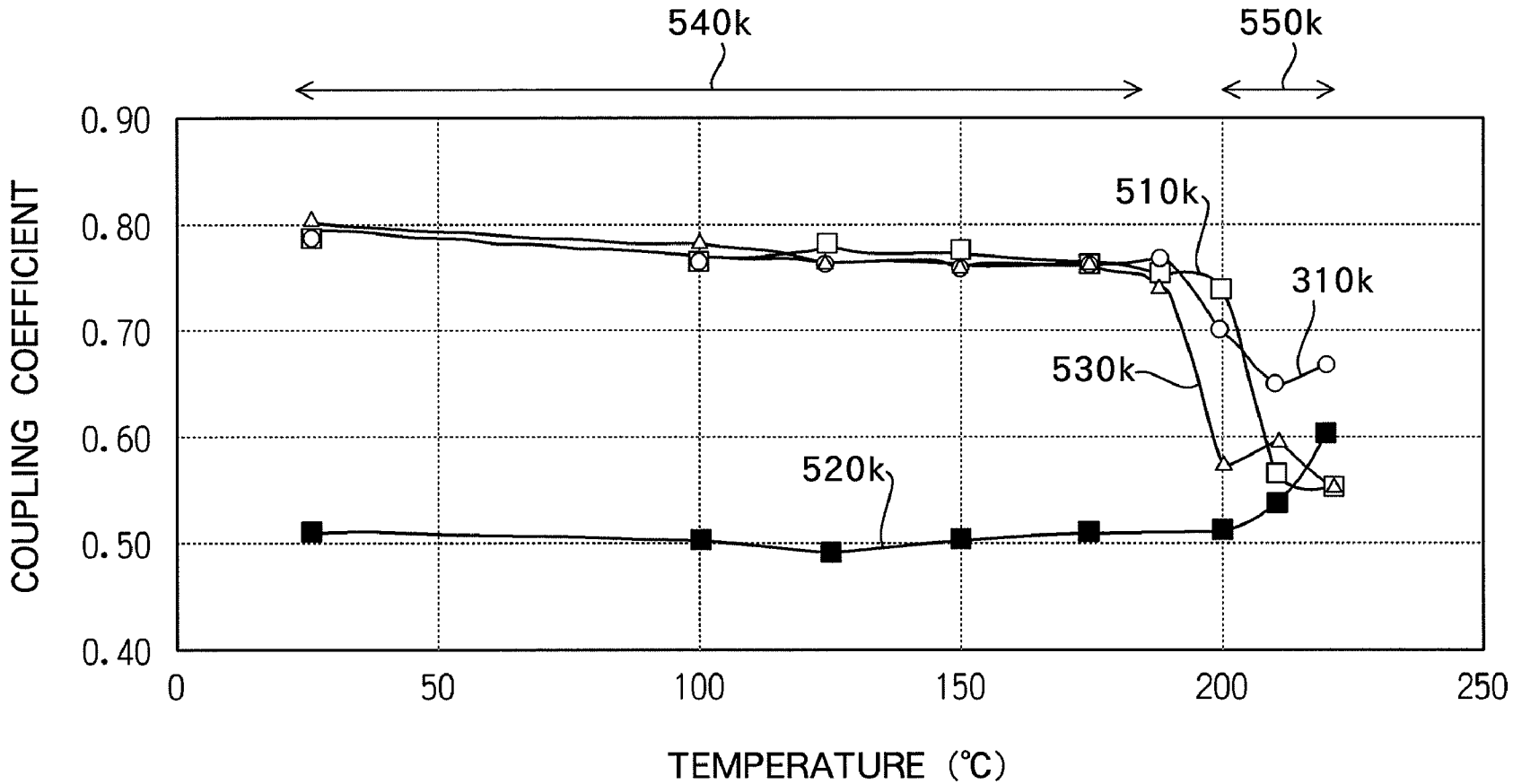
FIG. 12 shows a variation of coupling coefficient k of the equivalent circuit according to Embodiment 2.

The correspondences between resistance R, inductance L and coupling coefficient k of the equivalent circuit shown in FIG. 4, and temperature will be shown in FIG. 10 to FIG. 12 in this embodiment.

In FIG. 10, curve 510*r* plotted with white squares indicates resistance R according to this embodiment. Furthermore, curve 310*r* plotted with white circles indicates resistance R according to Embodiment 1, curve 520*r* plotted with black squares indicates the resistance when a temperature compensator alloy is used alone for the heating roller, and curve 530*r* plotted with white triangles indicates the resistance when aluminum is used as the material of non-magnetic electric conductor 410.

As shown in the same figure, in section 540*r* in which the temperature is equal to or below the Curie temperature, resistance R according to this embodiment is substantially the same as resistance R according to Embodiment 1 and is greater than the resistance of temperature compensator alloy alone. As in the case of Embodiment 1, this means that more Joule heat is generated at heating roller 210*a*, and heat generation is promoted more than when a temperature compensator alloy is used alone for the heating roller. Furthermore, heat generation is also promoted in substantially the same way when aluminum is used as the material of non-magnetic electric conductor 410. That is, in heat generation of heating roller 210*a* in section 540*r* in which the temperature is equal to or below the Curie temperature, the presence/absence or material of non-magnetic electric conductor 410 is not much relevant, and the effect of increases in resistance R due to the lamination of highly magnetically permeable conductive layer 212*a* and non-magnetic conductive layer 214 can be said to be dominant. This can also be confirmed by the fact that magnetic flux M permeates not farther than non-magnetic conductive layer 214 and the neighborhood of the outer surface of highly magnetically permeable conductive layer 212*a* in section 540*r* (see FIG. 8(*a*)).

On the other hand, in section 550*r* in which the temperature is equal to or above the Curie temperature, it can be understood that resistance R falls down to a value smaller than resistance R according to Embodiment 1 and the resistance of the temperature compensator alloy alone, and that the amount of generated heat further decreases. It can be considered that this is because when the temperature exceeds the Curie temperature and the skin depth increases in this embodiment, magnetic flux M penetrates heating roller 210*a*, permeates non-magnetic electric conductor 410 in which heat is hardly generated, so that an eddy current is generated in non-magnetic electric conductor 410 in a direction in which magnetic flux M is canceled out, and magnetic flux M decreases more than Embodiment 1. Furthermore, when aluminum is used for non-magnetic electric conductor 410, there is a tendency substantially similar to that when copper is used.

In FIG. 11, curve 5101 plotted with white squares indicates inductance L according to this embodiment. Furthermore, curve 3101 plotted with white circles indicates inductance L according to Embodiment 1, curve 5201 plotted with black squares indicates inductance when the temperature compensator alloy is used alone for the heating roller, and curve 5301 plotted with white triangles indicates inductance when aluminum is used as the material of non-magnetic electric conductor 410.

As shown in the same figure, in section 5401 in which the temperature is equal to or below the Curie temperature, inductance L according to this embodiment is substantially the same as inductance L according to Embodiment 1 and is smaller than inductance of the temperature compensator alloy alone. Therefore, as in the case of Embodiment 1, it can be understood that power is more easily supplied when non-magnetic conductive layer 214 is laminated than when the temperature compensator alloy is used alone for the heating roller.

On the other hand, in section 5501 in which the temperature is equal to or above the Curie temperature, inductance L according to this embodiment falls down to a small value more drastically than inductance L according to Embodiment 1. Furthermore, even when aluminum is used for non-magnetic electric conductor 410, the same tendency as that of inductance L according to this embodiment is shown. It can be considered that this is because when the temperature exceeds the Curie temperature, magnetic flux M penetrates heating roller 210*a* and permeates non-magnetic conductor 410, so that an eddy current is generated in non-magnetic electric conductor 410 in a direction in which magnetic flux M is canceled out, and magnetic flux M decreases more than the case in Embodiment 1.

In FIG. 12, curve 510*k* plotted with white squares indicates coupling coefficient k according to this embodiment. On the other hand, curve 310*k* plotted with white circles indicates coupling coefficient k according to Embodiment 1, curve 520*k* plotted with black squares indicates the coupling coefficient when the temperature compensator alloy is used alone for the heating roller, and curve 530*k* plotted with white triangles indicates the coupling coefficient when aluminum is used as the material of non-magnetic electric conductor 410.

As shown in the same figure, in section 540*k* in which the temperature is equal to or below the Curie temperature, coupling coefficient k according to Embodiment 1 is substantially the same as coupling coefficient k according to this embodiment and is greater than the coupling coefficient of the temperature compensator alloy alone. This means that the magnetic coupling of the system which consists of heating roller 210*a* and excitation coil 244 is good as in the case of Embodiment 1, and heat is generated more efficiently than when the temperature compensator alloy is used alone for the heating roller.

On the other hand, in section 550*k* in which the temperature is equal to or above the Curie temperature, it can be understood that coupling coefficient k according to this embodiment falls down to a value which is smaller than coupling coefficient k according to Embodiment 1 and that the efficiency of the heat generation further deteriorates. That is, in this embodiment, in a high temperature condition in which the temperature exceeds a Curie temperature, the amount of generated heat of heating roller 210*a* decreases more than Embodiment 1, and a temperature rise is further restrained.

As shown above, when the temperature variation of parameters of heating roller 210*a* in which non-magnetic electric conductor 410 is disposed inside is compared to that of heating roller 210 according to Embodiment 1, it can be understood that there is not so a big difference when the temperature is lower than the Curie temperature. As described above, it can be considered that this is because when the temperature is relatively low, magnetic flux M permeates not farther than the neighborhood of the outer surface of heating roller 210*a*, and non-magnetic electric conductor 410 disposed inside heating roller 210*a* is not involved in heat generation.

On the other hand, when the differences in inductance L, resistance R and coupling coefficient k between a case where the temperature of heating roller 210*a* is equal to or below the Curie temperature and a case where the temperature exceeds the Curie temperature are observed, the differences in all these values increase more than in Embodiment 1 in which non-magnetic electric conductor 410 is not disposed. This means that the difference in the amount of generated heat between a paper passage area and the area other than the paper passage area when narrow recording materials are successively passed and the temperature outside the width of the recording material is controlled so as to be equal to or below the Curie temperature is greater than that in the case of Embodiment 1. As a result, heat generation in the part which approximates to a Curie temperature becomes very small, and it is possible to suppress a temperature rise outside the width of the recording material to a minimum.

Moreover, since non-magnetic electric conductor 410 is provided inside heating roller 210*a* in this embodiment, it is possible to reduce the thickness of highly magnetically permeable conductive layer 212*a* and reduce the heat capacity of heating roller 210*a*. Therefore, the warm-up time of fixing apparatus 200 can be further reduced. Furthermore, magnetic flux which has penetrated heating roller 210*a* does not permeate or heat auxiliary roller 420.

Embodiment 3

A feature of Embodiment 3 of the present invention is to dispose an excitation coil inside a heating roller to reduce the size of a fixing apparatus.

Since the schematic configuration of the image forming apparatus according to this embodiment is similar to that of Embodiment 1 (FIG. 1), explanations thereof will be omitted. According to this embodiment, only the configuration of fixing apparatus 200 is different from that of Embodiment 1.

Figure 13:
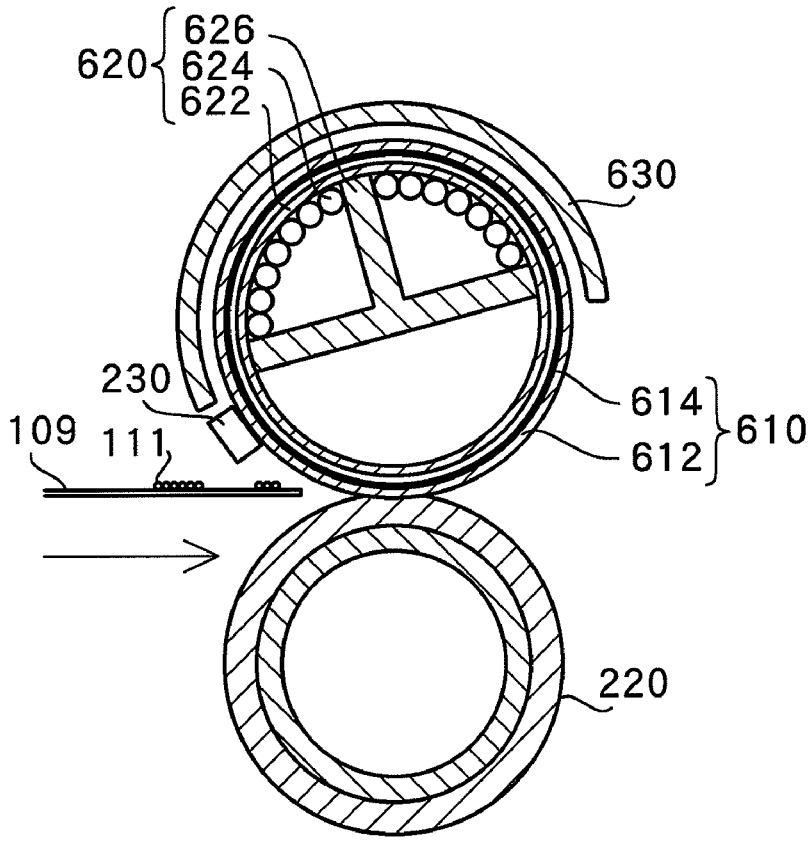
FIG. 13 is a cross-sectional view showing the configuration of a fixing apparatus according to Embodiment 3 of the present invention.

FIG. 13 is a cross-sectional view showing the configuration of fixing apparatus 200 according to this embodiment. In the same figure, parts that are identical with ones of fixing apparatus 200 (FIG. 2) will be assigned the same reference numerals without further explanations. Fixing apparatus 200 according to this embodiment adopts a configuration substituting heating roller 610 and excitation coil unit 620 for heating roller 210 and excitation coil unit 240 of fixing apparatus 200 according to Embodiment 1 and adding non-magnetic electric conductor 630.

Heating roller 610 is, for example, a cylindrical roller whose bottom surface has a diameter of 34 mm and rotates around the central axis so as to convey recording paper 109 on which toner image 111 is formed and carried in the direction indicated by an arrow (counterclockwise in the figure).

Figure 14:
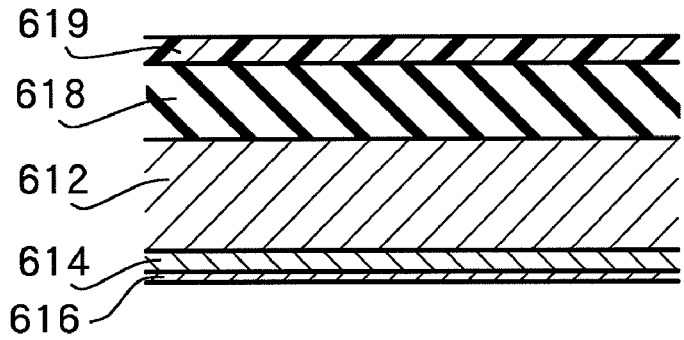
FIG. 14 is a partial cross-sectional view showing the detailed configuration of a heating roller according to Embodiment 3.

Furthermore, heating roller 610 is mainly formed by laminating highly magnetically permeable conductive layer 612 and non-magnetic conductive layer 614. More specifically, as shown in FIG. 14, Ni layer 616, non-magnetic conductive layer 614, highly magnetically permeable conductive layer 612, silicon rubber layer 618 and mold release layer 619 are laminated in that order from the side closest to the central axis of heating roller 610. Of these layers, highly magnetically permeable conductive layer 612, non-magnetic conductive layer 614, Ni layer 616 and mold release layer 619 have different layer positions, but the thickness and the material are similar to those of highly magnetically permeable conductive layer 212, non-magnetic conductive layer 214, Ni layer 216 and mold release layer 218 (FIG. 3) according to Embodiment 1.

This embodiment provides excitation coil unit 620 inside heating roller 610, and therefore the inside/outside relationship between highly magnetically permeable conductive layer 212 and non-magnetic conductive layer 214 in Embodiment 1 is reversed, and highly magnetically permeable conductive layer 612 is provided on the outer surface side of heating roller 610, and non-magnetic conductive layer 614 is processed on the inner surface of highly magnetically permeable conductive layer 612 by means of plating or the like.

Since silicon rubber layer 618 is formed on the outer surface of highly magnetically permeable conductive layer 612 in this embodiment, the peripheral surface of heating roller 610 has elasticity, and both rollers can be made to have close contact with each other at the nip formed between heating roller 610 and pressure rollers 220.

Referring to FIG. 13 again, excitation coil unit 620 has coil holding member 622, excitation coil 624 and core member 626.

Coil holding member 622 is formed of a cylindrical insulator disposed opposite to the inner surface of heating roller 610.

Excitation coil 624 is formed by winding a conductor around the surface opposite to the surface facing heating roller 610 of coil holding member 622 and generates magnetic flux therearound when a voltage is applied from a power supply (not shown) and an AC current flows.

Core member 626 is formed with a magnetic material having high magnetic permeability and high specific resistance such as ferrite and permalloy and has a substantially T-shaped section. More specifically, core member 626 contacts coil holding member 622 at the winding center of the conductor forming excitation coil 624 and at the outermost edges of the winding and has a shape connecting these parts with a plane. Core member 626 becomes a magnetic path for magnetic flux generated on the opposite side of heating roller 610 out of the magnetic flux generated by excitation coil 624.

Non-magnetic electric conductor 630 is made of a semi-cylindrical non-magnetic material having a thickness of, for example, 500 μm and disposed opposite to excitation coil unit 620 across the peripheral surface of heating roller 610. When the temperature of heating roller 610 exceeds a Curie temperature, non-magnetic electric conductor 630 has a greater skin depth and becomes a magnetic path for magnetic flux which penetrates the peripheral surface of heating roller 610. Therefore, even if the thickness of highly magnetically permeable conductive layer 612 is reduced, surrounding members are never heated by the magnetic flux that penetrates heating roller 610. Since the heat capacity of heating roller 610 becomes smaller, it is possible to further promote heat generation of heating roller 610.

Though non-magnetic electric conductor 630 is disposed outside heating roller 610 in this embodiment, excitation coil unit 620 which is bigger than non-magnetic electric conductor 630 is disposed inside heating roller 610, so that it is possible to reduce the size of fixing apparatus 200.

Next, the principle of heat generation by fixing apparatus 200 configured as described above will be explained.

In the case where the temperature of heating roller 610 is equal to or below the Curie temperature in this embodiment, when an AC current flows through excitation coil 624, magnetic flux is generated around excitation coil 624. The generated magnetic flux penetrates non-magnetic conductive layer 614 of heating roller 610, reaches highly magnetically permeable conductive layer 612 and permeates near the inner surface of highly magnetically permeable conductive layer 612 through a skin effect. This produces an eddy current for canceling out magnetic flux in non-magnetic conductive layer 614 and near the inner surface of highly magnetically permeable conductive layer 612, and non-magnetic conductive layer 614 and highly magnetically permeable conductive layer 612 are heated with Joule heat.

On the other hand, in the case where the temperature of heating roller 610 rises and exceeds the Curie temperature, highly magnetically permeable conductive layer 612 becomes non-magnetic, and magnetic flux penetrates this layer. The magnetic flux which has penetrated highly magnetically permeable conductive layer 612 permeates non-magnetic electric conductor 630, but as described in Embodiment 2, non-magnetic electric conductor 630 generates less heat, and the occurrence of an eddy current at heating roller 610 is also suppressed, so that the amount of generated heat of heating roller 610 decreases.

Thus, according to this embodiment, the excitation coil is provided inside the heating roller and the non-magnetic conductive layer is provided between this excitation coil and the highly magnetically permeable conductive layer of the heating roller, so that it is possible to shorten the warm-up time while preventing an excessive temperature rise and reduce the size of the fixing apparatus and consequently reduce the size of the image forming apparatus.

Embodiment 4

A feature of Embodiment 4 of the present invention is to provide a belt type fixing apparatus which transfers heat generated at a heating roller to a fixing roller using a belt and reduce the warm-up time while preventing an excessive temperature rise.

Since the schematic configuration of the image forming apparatus according to this embodiment is similar to that of Embodiment 1 (FIG. 1), explanations thereof will be omitted. In this embodiment, only the configuration of fixing apparatus 200 is different from that of Embodiment 1.

Figure 15:
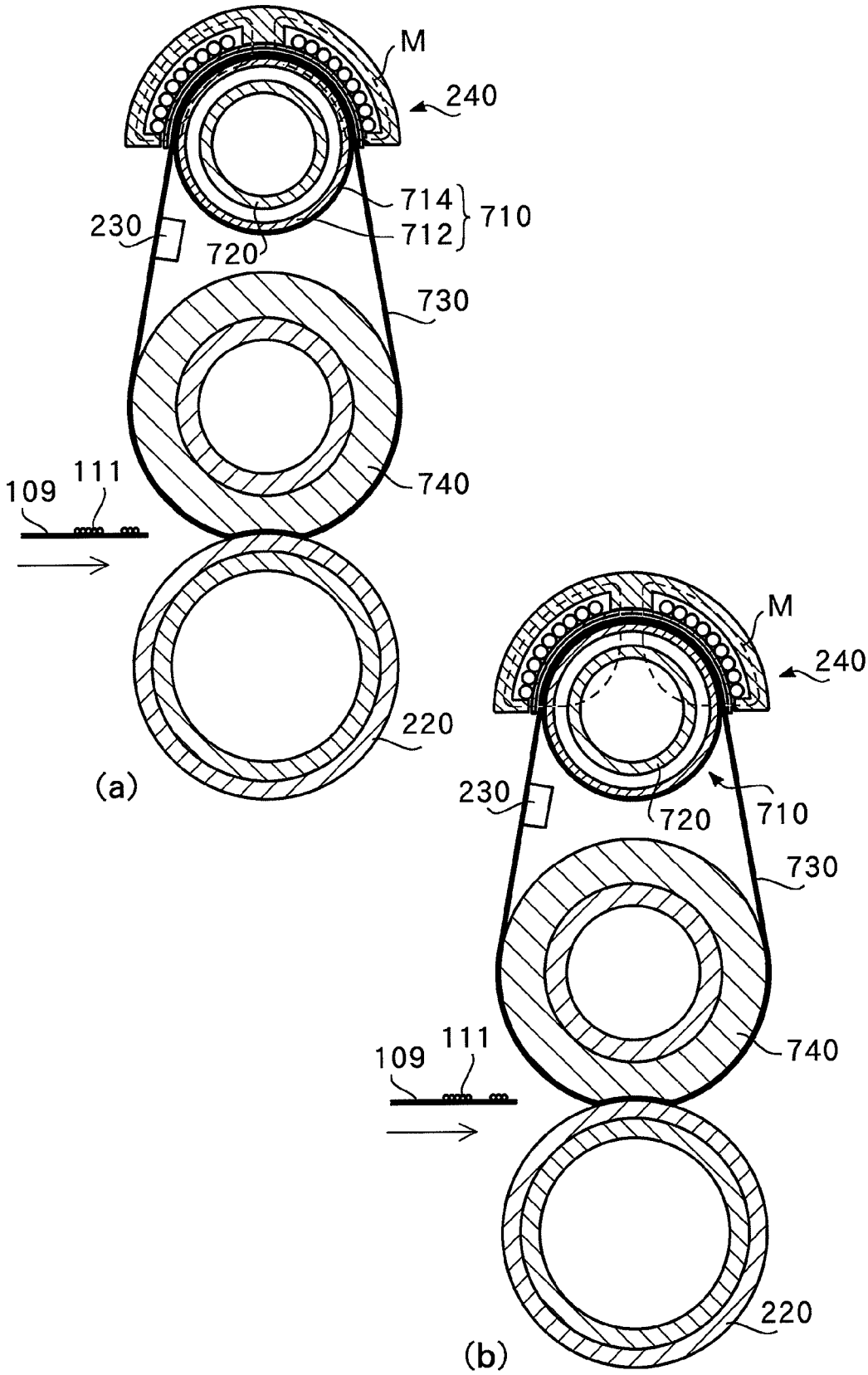
FIG. 15(*a*) is a cross-sectional view showing the configuration of a fixing apparatus according to Embodiment 4 of the present invention, and (b) is another cross-sectional view showing the configuration of the fixing apparatus according to Embodiment 4.

FIGS. 15(*a*) and (*b*) are cross-sectional views showing the configuration of fixing apparatus 200 according to this embodiment. FIG. 15(*a*) shows a magnetic path of magnetic flux M when the temperature is equal to or below the Curie temperature, and FIG. 15(*b*) shows a magnetic path of magnetic flux M when the temperature exceeds the Curie temperature. In these figures, parts that are identical with ones in fixing apparatus 200 (FIG. 2) according to Embodiment 1 will be assigned the same reference numerals without further explanations. Fixing apparatus 200 according to this embodiment has heating roller 710, non-magnetic electric conductor 720, belt 730, fixing roller 740, pressure roller 220, temperature sensor 230 and excitation coil unit 240.

Heating roller 710 is a cylindrical roller whose bottom surface has a diameter of, for example, 20 mm and rotates around the central axis so that belt 730 looped over this roller conveys recording paper 109 in the direction indicated by an arrow (counterclockwise in the figure).

Furthermore, heating roller 710 is mainly formed by laminating highly magnetically permeable conductive layer 712 and non-magnetic conductive layer 714. More specifically, highly magnetically permeable conductive layer 712, non-magnetic conductive layer 714 and Ni layer are laminated in that order from the side closest to the central axis of heating roller 710.

Highly magnetically permeable conductive layer 712 is made of a temperature compensator alloy whose Curie temperature is set to a predetermined temperature and is formed into a cylindrical shape having a thickness of, for example, 200 μm. Highly magnetically permeable conductive layer 712 is similar to highly magnetically permeable conductive layer 212*a* according to Embodiment 2 except in that it differs in the diameter.

Non-magnetic conductive layer 714 is a layer of, for example, 10 μm in thickness which is subjected to plating, metalizing or processing using a clad material and formed on the outer surface of highly magnetically permeable conductive layer 712. Non-magnetic conductive layer 714 is similar to non-magnetic conductive layer 214 according to Embodiment 1 except in that it differs in the diameter and the thickness.

An Ni layer is laminated on the outer surface of non-magnetic conductive layer 714, and this Ni layer is similar to Ni layer 216 according to Embodiment 1. Furthermore, the Ni layer in this embodiment prevents abrasion of heating roller 710 through the contact with belt 730 and prevents meandering or leaning of belt 730 by reducing a frictional coefficient. It is also possible to form a single or laminated layer of chromium, zinc or a fluorine-based resin instead of the Ni layer.

Non-magnetic electric conductor 720 is made of, for example, a cylindrical non-magnetic material of 500 μm in thickness, formed integrally with heating roller 710 and rotates around the same central axis as that of heating roller 710. As the material of non-magnetic electric conductor 720, copper, aluminum, silver, gold or the like can be used in the same way as non-magnetic electric conductor 410 of Embodiment 2. As shown in FIG. 15(*b*), when the temperature of heating roller 710 exceeds a Curie temperature, the skin depth thereof increases, magnetic flux M penetrates heating roller 710 and permeates non-magnetic electric conductor 720. Magnetic flux M then passes through non-magnetic electric conductor 720, and an eddy current is generated at that time in non-magnetic electric conductor 720 in the direction in which magnetic flux M attenuates, and it is thereby possible to drastically decrease magnetic flux in the part which exceeds the Curie temperature of heating roller 710 and prevent an excessive temperature rise. Furthermore, non-magnetic electric conductor 720 at this time is made up of a material having small specific resistance and large thickness, so that it has small skin resistance and generates less heat.

Furthermore, since non-magnetic electric conductor 720 is formed integrally with heating roller 710 and rotates, the structure of the fixing apparatus can thereby be simplified, and moreover magnetic flux never passes concentrated on a certain part of non-magnetic electric conductor 720 and can reliably suppress heat generation for a period of high temperature.

Belt 730 is an endless belt looped over heating roller 710 and fixing roller 740 and transfers heat of heating roller 710 to a nip formed by fixing roller 740 and pressure roller 220. Belt 730 is formed using heat-resistant polyimide resin of 45 mm in diameter and 80 μm in thickness as a base material with a 150 μm silicon rubber layer and a 30 μm fluororesin mold release layer which coat the surface of this base material. The size and material of belt 730 are not limited to those described above, and it is possible to use fluororesin and PPS or the like for the base material in addition to polyimide resin or disperse powder of a conductive material over this base material or use a thin metal such as nickel and stainless steel manufactured by electrocasting. Furthermore, it is also possible to use resin and rubber having a good mold release characteristic such as PTFE, PFA, FEP and fluororubber singly or in combination.

Fixing roller 740 is a cylindrical roller whose bottom surface has a diameter of, for example, 30 mm, pressed against pressure roller 220 through belt 730 and forms a nip through which recording paper 109 passes. Fixing roller 740 then rotates around the central axis (counterclockwise in the figure) so as to convey recording paper 109 in the direction indicated by an arrow following the transfer of belt 730 by the rotation of heating roller 710. Furthermore, fixing roller 740 is formed with a material of low heat conduction such as silicon rubber of JISA hardness of 30 degrees or the like. As fixing roller 740, it is also possible to use foamed silicon rubber.

Next, the principle of heat generation of fixing apparatus 200 configured as described above will be explained.

In the case where the temperature of heating roller 710 is equal to or below the Curie temperature in this embodiment, when an AC current flows through excitation coil 244, magnetic flux M is generated around excitation coil 244 as shown in FIG. 15(*a*). Generated magnetic flux M penetrates belt 730 and non-magnetic conductive layer 714 of heating roller 710, reaches highly magnetically permeable conductive layer 712 and permeates near the outer surface of highly magnetically permeable conductive layer 712 through a skin effect. This produces an eddy current for canceling out magnetic flux M in non-magnetic conductive layer 714 and near the outer surface of highly magnetically permeable conductive layer 712, and non-magnetic conductive layer 714 and highly magnetically permeable conductive layer 712 are heated with Joule heat.

The heat generated in non-magnetic conductive layer 714 and highly magnetically permeable conductive layer 712 is transferred to the nip between fixing roller 740 and pressure roller 220 through belt 730 and is used for the fixing of toner image 111 on recording paper 109.

On the other hand, in the case where the temperature of heating roller 710 rises and exceeds the Curie temperature, highly magnetically permeable conductive layer 712 becomes non-magnetic, and magnetic flux M penetrates this layer as shown in FIG. 15(*b*) Magnetic flux M which has penetrated highly magnetically permeable conductive layer 712 permeates non-magnetic electric conductor 720, but as described in Embodiment 2, non-magnetic electric conductor 720 generates less heat, and since the occurrence of an eddy current at heating roller 710 is also restrained, the amount of generated heat of heating roller 710 decreases.

In this way, according to this embodiment, the heating roller is formed by laminating the highly magnetically permeable conductive layer and the non-magnetic conductive layer, the heating roller is excited by the excitation coil, and generated heat is transferred to the nip using the belt, so that it is possible to shorten the warm-up time while preventing an excessive temperature rise, prevent the occurrence of an offset and realize high fixing performance at the belt type fixing apparatus, too.

Embodiment 5

A feature of Embodiment 5 of the present invention is to provide a belt type fixing apparatus wherein the belt passing between an excitation coil and a heating roller is provided with a function as a non-magnetic conductive layer to thereby simplify the structure of the heating roller.

Since the schematic configuration of the image forming apparatus according to this embodiment is similar to that of Embodiment 1 (FIG. 1), explanations thereof will be omitted. In this embodiment, only the configuration of fixing apparatus 200 is different from that of Embodiment 1.

Figure 16:
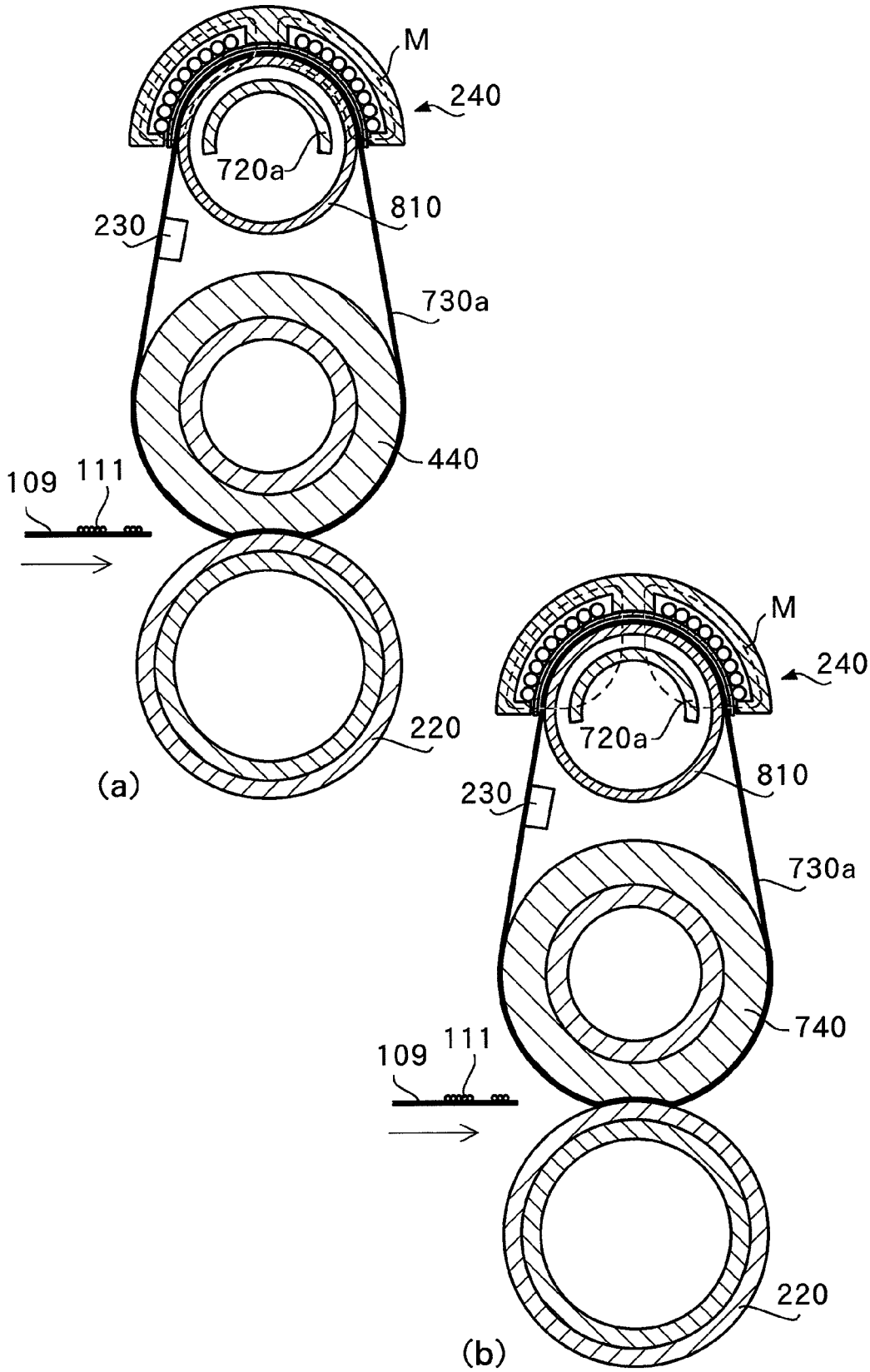
FIG. 16(*a*) is a cross-sectional view showing the configuration of a fixing apparatus according to Embodiment 5 of the present invention, and (b) is another cross-sectional view showing the configuration of the fixing apparatus according to Embodiment 5.

FIGS. 16(*a*) and (*b*) are cross-sectional views showing the configuration of the fixing apparatus 200 according to this embodiment. FIG. 16(*a*) shows a magnetic path of magnetic flux M when the temperature is equal to or below a Curie temperature, and FIG. 16(*b*) shows a magnetic path of magnetic flux M when the temperature exceeds the Curie temperature. In these figures, parts that are identical with ones in fixing apparatus 200 (FIG. 2) according to Embodiment 1 and fixing apparatus 200 (FIG. 15) according to Embodiment 4 will be assigned the same reference numerals without further explanations. Fixing apparatus 200 according to this embodiment adopts a configuration substituting heating roller 810, non-magnetic electric conductor 720*a* and belt 730*a* for heating roller 710, non-magnetic electric conductor 720 and belt 730 of fixing apparatus 200 according to Embodiment 4, respectively.

Heating roller 810 is a cylindrical roller whose bottom surface has a diameter of, for example, 20 mm and rotates around the central axis so that belt 730*a* looped over this roller conveys recording paper 109 in the direction indicated by an arrow (counterclockwise in the figure).

Furthermore, heating roller 810 does not have any non-magnetic conductive layer and is mainly formed with only a magnetically permeable conductive layer. More specifically, it has a simple configuration with a protection layer provided on the outer surface of a magnetically permeable conductive layer having a thickness of, for example, 200 μm. According to this embodiment, it is also possible to further simplify the configuration of heating roller 810 with no protection layer.

Unlike non-magnetic electric conductor 720 according to Embodiment 4, non-magnetic electric conductor 720*a* has a semi-cylindrical shape and does not rotate integrally with heating roller 810. Since non-magnetic electric conductor 720*a* is made to have a semi-cylindrical shape in this embodiment, non-magnetic electric conductor 720*a* has a small heat capacity and can thereby suppress the amount of heat deprived by non-magnetic electric conductor 720*a* from heating roller 810 to a minimum.

Belt 730*a* is an endless belt looped over heating roller 810 and fixing roller 740 and transfers heat of heating roller 810 to a nip formed by fixing roller 740 and pressure roller 220, and belt 730*a* itself is also heated through excitation of excitation coil unit 240 as will be described later. Belt 730*a* is formed using heat-resistant polyimide resin of 45 mm in diameter and 80 μm in thickness as a base material with silver powder dispersed over the surface of this base material and coated with a 150 μm silicon rubber layer and a 30 μm fluororesin mold release layer. The size and material of belt 730*a* are not limited to those described above, and it is possible to use fluororesin and PPS or the like for the base material in addition to polyimide resin or form a non-magnetic layer with high conductivity such as copper, silver or gold instead of dispersing silver powder. Furthermore, it is also possible to form a non-magnetic layer with high conductivity such as copper, silver or gold through plating, metalizing, cladding or the like on the surface of thin metal such as stainless steel. Furthermore, it is also possible to use resin and rubber having good mold releasability such as PTFE, PFA, FEP and fluororubber singly or in combination. However, according to this embodiment, since belt 730*a* functions as a non-magnetic conductive layer of heating roller 810, it is necessary to disperse silver or the like which is a non-magnetic material with high conductivity or form a layer thereof on the surface of the base material or in the base material.

That is, as shown in FIG. 16(*a*), belt 730*a* contacts heating roller 810 in the upper half of heating roller 810 which is covered with excitation coil unit 240, and it is possible to assume that they form a layer. Therefore, in this embodiment, heating roller 810 is mainly formed of only a magnetically permeable conductive layer, and belt 730*a* which makes up a layer with heating roller 810 is made to function as a non-magnetic conductive layer within a range in which excitation coil unit 240 performs excitation. Therefore, it is possible to simplify the configuration of heating roller 810, cause thin-film belt 730*a* with a small heat capacity itself to generate heat and further shorten the warm-up time.

Next, the principle of heat generation of fixing apparatus 200 configured as described above will be explained.

In the case where the temperature of heating roller 810 and belt 730*a* is equal to or below the Curie temperature in this embodiment, the flow of an AC current through excitation coil 244 produces magnetic flux M around excitation coil 244 as shown in FIG. 16(*a*). Generated magnetic flux M penetrates belt 730*a* and permeates near the outer surface of heating roller 810. This produces an eddy current for canceling out magnetic flux M to generate in belt 730*a* and near the outer surface of heating roller 810, and belt 730*a* and heating roller 810 are heated with Joule heat.

The heat generated in belt 730*a* and heating roller 810 is transferred to the nip between fixing roller 740 and pressure roller 220 through belt 730*a* and is used for the fixing of toner image 111 on recording paper 109.

On the other hand, in the case where the temperature of heating roller 810 and belt 730*a* rises and exceeds the Curie temperature, heating roller 810 becomes non-magnetic, and magnetic flux M penetrates heating roller 810 as shown in FIG. 16(*b*). Magnetic flux M which has penetrated heating roller 810 permeates non-magnetic electric conductor 720*a*. Magnetic flux M then passes through non-magnetic electric conductor 720*a*, but, at this time, an eddy current is generated in non-magnetic electric conductor 720*a* in a direction in which magnetic flux M attenuates, and it is possible to substantially reduce magnetic flux in the part whose temperature exceeds the Curie temperature of heating roller 710 and prevent an excessive temperature rise. As described in Embodiment 2, non-magnetic electric conductor 720*a* has small heat generation and the occurrence of an eddy current of heating roller 810 is also restrained, so that the amount of generated heat of heating roller 810 and belt 730*a* decreases. In this Embodiment 5 and Embodiment 4, heating roller 210 in a roller configuration is used as a heat generating section, and belt 730 is supported by heating roller 210, but the configuration is not limited to this, and it is possible to apply an arc-shaped support plate as the heat generating section and cause this support plate to support belt 730.

In this way, according to this embodiment, when the belt which functions as the non-magnetic conductive layer is looped over the heating roller which is made of a magnetically permeable conductive layer, and the part of contact between the heating roller and the belt is excited using the excitation coil, so that it is possible to shorten the warm-up time while preventing an excessive temperature rise and reduce cost by simplifying the structure of the heating roller.

Figure 17:
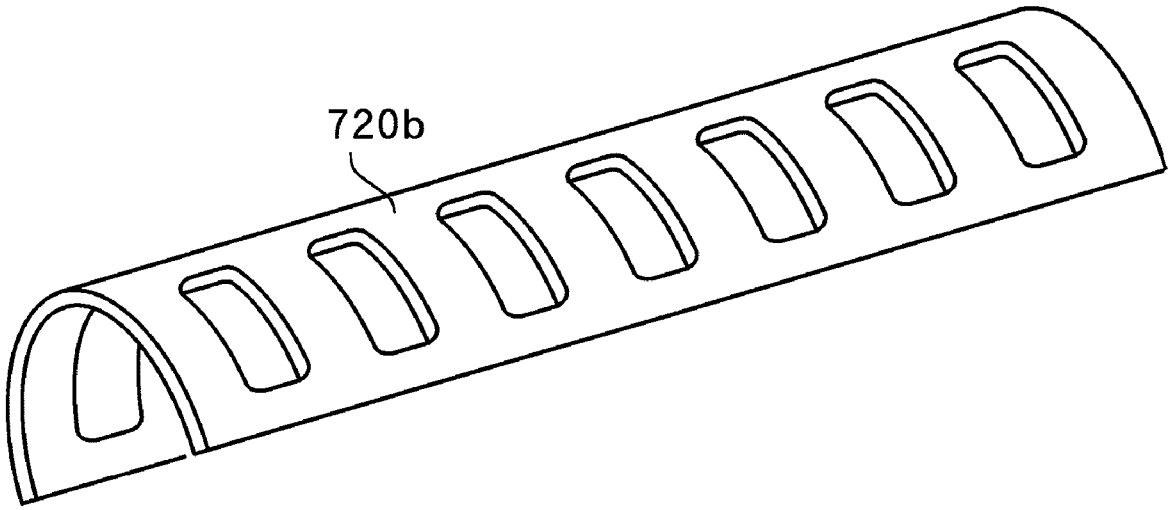
FIG. 17 shows a modification example of a non-magnetic electric conductor according to Embodiment 5.

When, for example, non-magnetic electric conductor 720*b* having holes as shown in FIG. 17 is used as the non-magnetic electric conductor to be disposed inside heating roller 810 in this embodiment, the resistance of the equivalent circuit increases slightly, and the reduction in the amount of generated heat is reduced slightly. However, the surface area of non-magnetic electric conductor 720*b* is small, and therefore heat deprived from heating roller 810 to non-magnetic electric conductor 720*b* decreases and the warm-up time can further be reduced. In a similar manner, it is also possible to provide holes in the non-magnetic electric conductor of Embodiments 2 to 4.

The fixing apparatus according to a first aspect of the present invention adopts a configuration including: an excitation section to which a voltage is applied for forming a magnetic field therearound; a heat generating section at least a part of which is disposed in a magnetic field formed by the excitation section and that generates heat by making magnetic flux generated in the magnetic field permeate inside; and a fixing section that heats and fixes an image formed and carried on a recording material using the heat of the heat generating section, wherein the heat generating section includes: a magnetically permeable conductive layer that is made of a temperature compensator material which has predetermined magnetism at a normal temperature and loses magnetism at a predetermined temperature or above; and a non-magnetic conductive layer that is laminated on the excitation section side of the magnetically permeable conductive layer.

According to this configuration, excitation is performed on a non-magnetic conductive layer laminated on a magnetically permeable conductive layer made of a temperature compensator material, so that magnetic coupling is improved, and heat generation is promoted for a period of low temperature which is equal to or below a Curie temperature compared to the case where the magnetically permeable conductive layer is excited alone, and, when the temperature at the part outside the width of the recording material becomes as high as close to the Curie temperature, heat generation at this part decreases rather than when the magnetically permeable conductive layer is excited alone. Therefore, it is possible to shorten the warm-up time while preventing an excessive temperature rise of the fixing apparatus, prevent the occurrence of an offset and damage and deterioration of the life of the rubber member and thereby realize high fixing performance.

The fixing apparatus according to a second aspect of the present invention adopts the configuration according to the first aspect of the present invention, wherein: the heat generating section further includes a non-magnetic electric conductor that is made of a non-magnetic material and opposite to the excitation section across the magnetically permeable conductive layer and the non-magnetic conductive layer; and the magnetically permeable conductive layer is formed to such a thickness that the magnetic flux penetrates and reaches the non-magnetic electric conductor at a temperature at which magnetism is lost.

According to this configuration, it is possible to reduce the thickness of the magnetically permeable conductive layer, reduce a heat capacity and thereby shorten the warm-up time for a period of low temperature. At the same time, for a period of high temperature which is equal to or above the Curie temperature, the magnetic flux penetrates the magnetically permeable conductive layer and reaches the non-magnetic electric conductor, so that an eddy current flows in the non-magnetic electric conductor in the direction in which magnetic flux M decreases, and it is possible to restrain heat generation of the magnetically permeable conductive layer and prevent an excessive temperature rise.

The fixing apparatus according to a third aspect of the present invention adopts the configuration according to the second aspect of the present invention, wherein the non-magnetic electric conductor is disposed partially opposite to the excitation section.

According to this configuration, the non-magnetic electric conductor is disposed partially opposite to the excitation section, so that the surface area of the non-magnetic electric conductor becomes small and it is possible to suppress the amount of the heat deprived from the magnetically permeable conductive layer and the non-magnetic conductive layer to the non-magnetic electric conductor to a minimum.

The fixing apparatus according to a fourth aspect of the present invention adopts the configuration according to the first aspect of the present invention, wherein the heat generating section includes a heating roller that is made up of the magnetically permeable conductive layer which is rotatable and cylindrical and the non-magnetically permeable conductive layer that is laminated on the surface of the magnetically permeable conductive layer on the excitation section side and rotates integrally with the magnetically permeable conductive layer.

According to this configuration, a magnetically permeable conductive layer and a non-magnetically permeable conductive layer are formed on the peripheral surface of the heating roller, and a non-magnetically permeable conductive layer is formed on the excitation section side of the magnetically permeable conductive layer, so that, when the heating roller is used as the heat generation section of the fixing apparatus, it is possible to shorten the warm-up time while preventing an excessive temperature rise, prevent the occurrence of an offset and realize high fixing performance.

The fixing apparatus according to a fifth aspect of the present invention adopts the configuration according to the fourth aspect of the present invention, wherein: the heat generating section further includes a non-magnetic electric conductor that is opposite to the excitation section across the peripheral surface of the heating roller; and the heating roller is formed to such a thickness that the magnetic flux penetrates the peripheral surface and reaches the non-magnetic electric conductor at a temperature at which the magnetically permeable conductive layer loses magnetism.

According to this configuration, magnetic flux penetrates the peripheral surface of the heating roller and reaches the non-magnetic electric conductor which is less likely to generate heat for a period of high temperature which is equal to or above the Curie temperature, so that it is possible to restrain heat generation of the heating roller and prevent an excessive temperature rise. Furthermore, it is also possible to reduce the thickness of the peripheral surface of the heating roller, reduce the heat capacity and promote heat generation for a period of low temperature.

The fixing apparatus according to a sixth aspect of the present invention adopts the configuration according to the fifth aspect of the present invention, wherein the non-magnetic electric conductor is formed along the peripheral surface of the heating roller and extends over only a range which is opposite to the excitation section.

According to this configuration, the non-magnetic electric conductor extends over only the range opposite to the excitation section, so that the heat capacity of the non-magnetic electric conductor becomes small, and it is thereby possible to suppress the amount of heat deprived from the heating roller to the non-magnetic conductor to a minimum.

The fixing apparatus according to a seventh aspect of the present invention adopts the configuration according to the fifth aspect of the present invention, wherein the non-magnetic electric conductor is formed into a cylindrical shape along the peripheral surface of the heating roller and rotates integrally with the heating roller.

According to this configuration, the non-magnetic electric conductor is formed into a cylindrical shape along the peripheral surface of the heating roller and rotates integrally therewith, so that it is possible to simplify the structure of the fixing apparatus, prevent magnetic flux from concentrating on part of the non-magnetic electric conductor and passing, and reliably restrain heat generation for a period of high temperature.

The fixing apparatus according to an eighth aspect of the present invention adopts the configuration according to the fourth aspect of the present invention, wherein the excitation section includes an excitation coil that is disposed opposite to the outer surface of the heating roller and excites the heating roller from outside.

According to this configuration, the excitation coil is disposed outside the heating roller, so that it is possible to improve the operation efficiency of replacement and maintenance of parts such as the heating roller which is consumable.

The fixing apparatus according to a ninth aspect of the present invention adopts the configuration according to the fourth aspect of the present invention, wherein the excitation section includes an excitation coil that is disposed opposite to the inner surface of the heating roller and excites the heating roller from inside.

According to this configuration, the excitation coil is disposed inside the heating roller, so that it is possible to reduce the size of the fixing apparatus.

The fixing apparatus according to a tenth aspect of the present invention adopts the configuration according to the first aspect of the present invention, wherein the heat generating section includes: a rotating cylindrical heating roller; and an endless belt that is looped over the heating roller and transfers heat to the fixing section, wherein: the magnetically permeable conductive layer is formed on the peripheral surface of the heating roller and rotates; and the non-magnetically permeable conductive layer is formed on the belt and rotates integrally with the rotation of the magnetically permeable conductive layer.

According to this configuration, a magnetically permeable conductive layer is formed on the peripheral surface of the heating roller, and a non-magnetically permeable conductive layer is formed on the belt looped over the heating roller, so that it is possible to simplify the structure of the heating roller of the belt type fixing apparatus, and, the thin, small heat capacity belt itself generates heat, so that it is possible to promote heat generation and further shorten the warm-up time.

The fixing apparatus according to an eleventh aspect of the present invention adopts the configuration according to the first aspect of the present invention, wherein the heat generating section further includes a protection layer that is laminated on the excitation section side of the non-magnetic conductive layer.

According to this configuration, a protection layer is laminated on the excitation section side of the non-magnetic conductive layer, so that it is possible to prevent oxidation of the non-magnetic conductive layer and improve durability.

The fixing apparatus according to a twelfth aspect of the present invention adopts the configuration according to the first aspect of the present invention, wherein the non-magnetic conductive layer has a thickness of 2 μm to 30 μm.

According to this configuration, the resistance of the non-magnetic conductive layer is optimized, and the amount of generated heat increases.

The fixing apparatus according to a thirteenth aspect of the present invention adopts the configuration according to the first aspect of the present invention, wherein the non-magnetic conductive layer is made of a metallic material whose specific resistance is $10\times10^{-6}$ Ωcm or below.

According to this configuration, it is possible to obtain optimum resistance with a small thickness and increase the amount of generated heat without increasing the heat capacity.

The fixing apparatus according to a fourteenth aspect of the present invention adopts the configuration according to the first aspect of the present invention, wherein a current at a frequency of 20 kHz to 100 kHz is applied to the excitation section.

According to this configuration, it is possible to increase the amount of generated heat with a small power loss and a low-cost circuit configuration.

The fixing apparatus according to a fifteenth aspect of the present invention adopts the configuration according to the first aspect of the present invention, wherein the magnetically permeable conductive layer has a thickness of 0.3 mm to 1 mm.

According to this configuration, it is possible to secure mechanical strength while restraining increase in the heat capacity of the magnetically permeable conductive layer, restrain penetration to magnetic flux and reduce the amount of generated heat.

The fixing apparatus according to a sixteenth aspect of the present invention adopts the configuration according to the second aspect of the present invention, wherein the magnetically permeable conductive layer has a thickness of 0.1 mm to 0.5 mm.

According to this configuration, it is possible to further reduce the heat capacity of the magnetically permeable conductive layer and shorten the warm-up time.

The fixing apparatus according to a seventeenth aspect of the present invention adopts the configuration according to the fifth aspect of the present invention, wherein the non-magnetic electric conductor has a thickness of 0.2 mm to 2 mm.

According to this configuration, the opposite magnetic field reduces magnetic flux, reduces the amount of generated heat and prevents the heat capacity of the non-magnetic electric conductor from drastically increasing and prevents the warm-up time by heat absorption into the non-magnetic electric conductor from extending.

The image forming apparatus according to an eighteenth aspect of the present invention adopts a configuration including the fixing apparatus according to one of the first to seventeenth aspects of the present invention.

According to this configuration, it is possible to realize operation effects similar to those of the fixing apparatus according to one of the first to seventeenth aspects of the present invention.

The heating roller according to a nineteenth aspect of the present invention is a heating roller that is disposed in a magnetic field formed by an excitation section and generates heat by making magnetic flux generated in the magnetic field permeate inside and adopts a configuration including: a magnetically permeable conductive layer that is made of a temperature compensator material which has predetermined magnetism at a normal temperature and loses magnetism at a predetermined temperature or above; and a non-magnetic conductive layer that is laminated on the excitation section side of the magnetically permeable conductive layer.

According to this configuration, excitation is performed on a non-magnetic conductive layer laminated on a magnetically permeable conductive layer made of a temperature compensator material, so that magnetic coupling is improved, and heat generation is promoted for a period of low temperature which is equal to or below a Curie temperature compared to the case where the magnetically permeable conductive layer is excited alone, and, when the temperature at the part outside the width of the recording material becomes as high as close to the Curie temperature, heat generation at this part decreases rather than when the magnetically permeable conductive layer is excited alone. Therefore, it is possible to shorten the warm-up time while preventing an excessive temperature rise of the fixing apparatus provided with the heating roller, prevent the occurrence of an offset and damage and deterioration of the life of the rubber member and thereby realize high fixing performance.

The heating roller according to a twentieth aspect of the present invention adopts the configuration according to the nineteenth aspect of the present invention, further including: a protection layer that is laminated on the excitation section side of the non-magnetic conductive layer; and a mold release layer that is laminated on the excitation section side of the protection layer.

According to this configuration, the protection layer and mold release layer are laminated on the excitation section side of the non-magnetic conductive layer, so that it is possible to prevent oxidation of the non-magnetic conductive layer and improve durability.

The present application is based on Japanese Patent Application No. 2004-217663, filed on Jul. 26, 2004, entire content of which is expressly incorporated by reference herein.

INDUSTRIAL APPLICABILITY

The fixing apparatus according to the present invention reduces a warm-up time while preventing an excessive temperature rise, prevents the occurrence of an offset and realizes high fixing performance and is suitable for use in a fixing apparatus or the like which heats and fixes an unfixed image on a recording material by using an electromagnetic induction heating scheme.

The invention claimed is:

1. A fixing apparatus, comprising:

an excitation section to which a voltage is applied for forming a magnetic field therearound;

a heat generating section, at least a part of which is disposed in a magnetic field formed by said excitation section and that generates heat by making a magnetic flux generated in the magnetic field permeate inside; and a fixing section that heats and fixes an image formed and carried on a recording material using the heat of said heat generating section, wherein said heat generating section comprises:

a magnetically permeable conductive layer that is made of a temperature compensator material which has a predetermined magnetism at a normal temperature and loses magnetism at a predetermined temperature or above; and a non-magnetic conductive layer that is laminated on an excitation section side of said magnetically permeable conductive layer.

2. The fixing apparatus according to claim 1, wherein:

said heat generating section further comprises a non-magnetic electric conductor that is made of a non-magnetic material and opposite to said excitation section across said magnetically permeable conductive layer and said non-magnetic conductive layer; and said magnetically permeable conductive layer is formed to such a thickness that said magnetic flux penetrates and reaches said non-magnetic electric conductor at a temperature at which magnetism is lost.

3. The fixing apparatus according to claim 2, wherein said non-magnetic electric conductor is disposed partially opposite to said excitation section.

4. The fixing apparatus according to claim 2, wherein said magnetically permeable conductive layer has a thickness of 0.1 mm to 0.5 mm.

5. The fixing apparatus according to claim 1, wherein said heat generating section comprises a heating roller that is made up of said magnetically permeable conductive layer which is rotatable and cylindrical and said non-magnetically permeable conductive layer that is laminated on a surface of said magnetically permeable conductive layer on the excitation section side and rotates integrally with said magnetically permeable conductive layer.

6. The fixing apparatus according to claim 5, wherein:

said heat generating section further comprises a non-magnetic electric conductor that is opposite to said excitation section across a peripheral surface of said heating roller; and said heating roller is formed to such a thickness that said magnetic flux penetrates the peripheral surface and reaches said non-magnetic electric conductor at a temperature at which said magnetically permeable conductive layer loses magnetism.

7. The fixing apparatus according to claim 6, wherein said non-magnetic electric conductor is formed along the peripheral surface of said heating roller and extends over only a range which is opposite to said excitation section.

8. The fixing apparatus according to claim 6, wherein said non-magnetic electric conductor is formed into a cylindrical shape along the peripheral surface of said heating roller and rotates integrally with said heating roller.

9. The fixing apparatus according to claim 6, wherein said non-magnetic electric conductor has a thickness of 0.2 mm to 2 mm.

10. The fixing apparatus according to claim 5, wherein said excitation section comprises an excitation coil that is disposed opposite to an outer surface of said heating roller and excites said heating roller from outside.

11. The fixing apparatus according to claim 5, wherein said excitation section comprises an excitation coil that is disposed opposite to an inner surface of said heating roller and excites said heating roller from inside.

12. The fixing apparatus according to claim 1, wherein said heat generating section comprises:

a rotating cylindrical heating roller; and an endless belt that is looped over said rotating cylindrical heating roller and transfers heat to said fixing section, wherein:

said magnetically permeable conductive layer is formed on a peripheral surface of said rotating cylindrical heating roller and rotates; and said non-magnetically permeable conductive layer is formed on said endless belt and rotates integrally with the rotation of said magnetically permeable conductive layer.

13. The fixing apparatus according to claim 1, wherein said heat generating section further comprises a protection layer that is laminated on an excitation section side of said non-magnetic conductive layer.

14. The fixing apparatus according to claim 1, wherein said non-magnetic conductive layer has a thickness of 2 μm to 30 μm.

15. The fixing apparatus according to claim 1, wherein said non-magnetic conductive layer is made of a metallic material whose specific resistance is $10 \times 10^6$ Ωcm or below.

16. The fixing apparatus according to claim 1, wherein a current at a frequency of 20 kHz to 100 kHz is applied to said excitation section.

17. The fixing apparatus according to claim 1, wherein said magnetically permeable conductive layer has a thickness of 0.3 mm to 1 mm.

18. An image forming apparatus comprising the fixing apparatus according to claim 1.

19. A heating roller that is disposed in a magnetic field formed by an excitation section and generates heat by making a magnetic flux generated in the magnetic field permeate inside, comprising:

a magnetically permeable conductive layer that is made of a temperature compensator material which has a predetermined magnetism at a normal temperature and loses magnetism at a predetermined temperature or above; and a non-magnetic conductive layer that is laminated on an excitation section side of said magnetically permeable conductive layer.

20. The heating roller according to claim 19, further comprising:

a protection layer that is laminated on an excitation section side of said non-magnetic conductive layer; and a mold release layer that is laminated on an excitation section side of said protection layer.

* * * * *

UNITED STATES PATENT AND TRADEMARK OFFICE

CERTIFICATE OF CORRECTION

PATENT NO. : 7,486,923 B2
APPLICATION NO. : 11/572521
DATED : February 3, 2009
INVENTOR(S) : Masaru Imai et al.

It is certified that error appears in the above-identified patent and that said Letters Patent is hereby corrected as shown below:

On the cover page item (22), "PCT Filed: July 26, 2005"
should be:
--PCT Filed: July 25, 2005--

Signed and Sealed this

Thirtieth Day of June, 2009

JOHN DOLL
*Acting Director of the United States Patent and Trademark Office*